US007427826B2

(12) United States Patent
Iba et al.

(10) Patent No.: US 7,427,826 B2
(45) Date of Patent: Sep. 23, 2008

(54) ELECTRON BEAM APPARATUS

(75) Inventors: Jun Iba, Kanagawa-ken (JP); Yasuo Ohashi, Kanagawa-ken (JP); Hisanobu Azuma, Kanagawa-ken (JP); Takahiro Hachisu, Kanagawa-ken (JP); Masanori Takahashi, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 499 days.

(21) Appl. No.: 11/331,111

(22) Filed: Jan. 13, 2006

(65) Prior Publication Data

US 2006/0164001 A1 Jul. 27, 2006

(30) Foreign Application Priority Data

Jan. 25, 2005 (JP) ..... 2005-016629
Jan. 25, 2005 (JP) ..... 2005-016630

(51) Int. Cl.
*H01J 1/00* (2006.01)
*H01J 9/02* (2006.01)

(52) U.S. Cl. ..... 313/236; 313/313; 313/314; 313/237; 313/495; 313/311

(58) Field of Classification Search ..... 313/495–497, 313/304, 306–308, 309–311, 313–314, 236–237; 315/169.1–169.3; 445/5–6; 345/74.1, 75.1, 345/75.2

See application file for complete search history.

(56) References Cited

U.S. PATENT DOCUMENTS 5,839,363 A * 11/1998 Yanagisawa et al. ..... 101/123
6,137,218 A * 10/2000 Kaneko et al. ..... 313/495
6,703,791 B2 3/2004 Azuma ..... 315/169.3
6,853,128 B2 2/2005 Hachisu ..... 313/495
6,972,203 B2 12/2005 Azuma ..... 438/20
7,067,236 B2 6/2006 Yamada et al. ..... 430/312
7,097,530 B2 8/2006 Katakura et al. ..... 445/50
7,151,005 B2 12/2006 Azuma ..... 438/20
7,301,268 B2 * 11/2007 Kang et al. ..... 313/495
2003/0062843 A1 4/2003 Katakura et al. ..... 315/619.3
2006/0063459 A1 3/2006 Iba et al. ..... 445/3
2006/0087219 A1 4/2006 Taniguchi et al. ..... 313/495
2006/0087220 A1 4/2006 Hiroki et al. ..... 313/495
2007/0020787 A1 1/2007 Azuma ..... 438/20
2007/0046173 A1 3/2007 Azuma et al. ..... 313/495

OTHER PUBLICATIONS

Takuma, T., "Electric Field Concentration in Composite Dielectrics", Journal of Electrostatic Japan, vol. 14, No. 1, pp. 40-48 (1990) and English Translation (pp. 1-22).

* cited by examiner

*Primary Examiner*—Mariceli Santiago
*Assistant Examiner*—Jose M Diaz
(74) *Attorney, Agent, or Firm*—Fitzpatrick, Cella, Harper & Scinto

(57) ABSTRACT

There provided is an electron beam apparatus of preventing surface creeping discharge from newly arising due to discharge that arises between an anode electrode and an electron-emitting device. In an electron-emitting device including a scan signal device electrode and an information signal device electrode, a portion of the scan signal device electrode is covered by an insulating layer of insulating scan signal wiring from information signal wiring, an additional electrode is connected to the scan signal device electrode at an end portion of the insulating layer and the additional electrode is configured so that energy Ee being lost due to melting of the additional electrode is larger than energy Ea of discharge current flowing in to the electron-emitting device.

8 Claims, 16 Drawing Sheets

ELECTRON BEAM APPARATUS

BACKGROUND OF THE INVENTION

1. Field of the Invention

The present invention relates to an electron beam apparatus in use of an electron-emitting device applied to a flat type image forming apparatus a 2. Related Background Art Conventionally, as a utilization mode of an electron-emitting device, an image forming apparatus is nominated. For example, there known is a flat type electron beam display panel with an electron source substrate (rear plate) having a great number of cold cathode electron-emitting devices being formed, an opposite substrate (face plate) comprising anode electrode and a fluorescent substance as a light emitting member being disposed in opposition in parallel and being exhausted to a vacuum state. A flat type electron beam display panel allows a plan to save weight and enlarge screen compared with a cathode beam tube (CRT) display apparatus that is currently being used widely. In addition, it can provide with images with higher luminance and with higher quality than those in another flat type display panel such as a flat type display panel in utilization of liquid crystal, a plasma display, an electro luminescent display etc.

Like this, in order to accelerate electrons emitted from a cold cathode electron-emitting device, it is advantageous for an image forming apparatus of such a type that applies a voltage between an anode electrode and a device to apply a high voltage in order to derive light emitting luminescence to the maximum limit. Corresponding with types of devices, emitted electron beams emanate before reaching the opposite electrode, and therefore, if a display with high resolution is intended to be realized, it is preferable that the inter-substrate distance between the rear plate and the face plate is short.

However, the inter-substrate distance gets shorter, then the electric field between the substrates gets high and therefore such a phenomenon that an electron-emitting device is destroyed by discharge becomes apt to take place. Japanese Patent Application Laid-Open No. 2003-157757 (U.S. Pat. No. 2003062843A) discloses a display apparatus having a resistant device being disposed on a connection route between a device electrode and wiring configuring an electron-emitting device in order to prevent influence due to discharge arising between an anode electrode and an electron-emitting device from reaching another electron-emitting device.

In the case where discharge arises between an anode electrode and an electron-emitting device, melting of an electrode and breaking taking place by the discharge might be accompanied by surface creeping discharge. That surface creeping discharge will be described with FIGS. 13A to 13F.

In FIGS. 13A to 13F, reference numeral 130 denotes wiring, reference numerals 131 and 132 denote device electrodes and reference numeral 139 denotes an insulating layer. Here, the upper surface is provided with an anode electrode (not shown in the drawing) and high voltage is applied.

The wiring 130 is formed by metal material with thicker film thickness and lower resistance than those of the device electrodes 131 and 132 and is connected to GND (ground). In addition, the device electrode 131 passes under the insulating layer 139 to extend to reach the wiring 130 and be electrically connected to the wiring 130. In addition, the device electrode 132 is connected to another wiring not shown in the drawing and is stipulated at a potential higher than that of the wiring 130.

In the configuration of FIGS. 13A to 13F, at first, discharge 133 arises in the device electrode 131 (FIG. 13A). Then, accompanied by progress in discharge, a cathode spot 134 arises (FIG. 13B). The cathode spot 134 refers to an electron-emitting point arising at the time of discharge and is an injection point of discharge current from the anode electrode (Reference: J. Appl. Phys., vol. 51, No. 3, 1414 (1980)). Since the cathode spot 134 moves to the negative potential side, the cathode-spot 134 goes for the wiring 130 close to GND here. As the discharge current increases, the device electrode 131 is heated and a melting portion 136 is generated (FIG. 13C). Therefore, resistance between the cathode spot 134 and the wiring 130 increases rapidly and consequently the potential of the device electrode 131 increases. That is, potential difference arises between the device electrodes 131 and 132 and surface creeping discharge 138 (discharge due to explosive increase in electron emission by an electric field) arises (FIG. 13D). Here, the route of the cathode spot 134 and the melting portion 136 remain as damage 137 subject to surface creeping discharge.

In addition, as a case different from FIG. 13C, the cathode spot 134 reaches at the end of the insulating layer 139 to stay at an end of the insulating layer 139 (FIG. 13E, the cathode spot 134 arises only in a portion that is exposed from the anode electrode). And, there is also a case (FIG. 13F) where the device electrode 131 is brought into melting and breaking so that surface creeping discharge 138 is caused to arise.

An actual electron beam apparatus has an electron-emitting device and an electric field enhancement coefficient of an electron-emitting device is high, and therefore surface creeping discharge to an adjacent electron-emitting device is apt to arise, requiring that potential increase is restrained to a low level.

The configuration disclosed in Japanese Patent Application Laid-Open No. 2003-157757 only controls the direction of flow of discharge current and will not prevent surface creeping discharge itself.

SUMMARY OF THE INVENTION

An object of the present invention to provide an electron beam apparatus that prevents surface creeping discharge newly arising due to discharge arising between an anode electrode and an electron-emitting device and is highly reliable. Moreover, another object is to provide the electron beam apparatus without adding cumbersome manufacturing process.

An object of the present invention is to provide an electron source comprising storing and durable electron-emitting devices which can reduce a damage by discharge even though undesirable discharge occurs. In other word, it is to provide the electron source comprising the strong and durable electron-emitting devices having an electron-structure which can prevent moving or propagating the discharging form one electron-emitting device to adjacent electron-emitting device.

An electron beam apparatus of the present invention comprises:

a rear plate comprising a plurality of electron-emitting devices comprising a pair of device electrodes, a plurality of first wirings each of which is connected to one of the pair of device electrodes of the electron-emitting device and a plurality of second wirings each of which is connected to the other of the pair of device electrodes, wherein the second wirings cross the first wirings sandwiching an insulating layer therebetween; and a face plate, comprising an anode electrode, disposed in opposition to the above described rear plate and irradiated with electron emitted from the above described electron-emitting device;

wherein at least one of the above described pair of device electrodes has a portion covered with the above described insulating layer in a side connected to the above described-first or second wirings, an additional electrode is electrically connected to an end of the device electrode covered with the insulating layer and the additional electrode meets the following Formulas (a) to (c).

$$Ee=P\times Cp\times\rho\times Tm \quad (a)$$

$$Ea=R\times I^2\times t_1 \quad (b)$$

$$Ee>Ea \quad (c)$$

P: volume [$m^3$]

Cp: specific heat [J/kgK]

ρ: density [$kg/m^3$]

Tm: melting point [K]

R: resistance [Ω]

I: permissible current value [A]

$t_1$: duration of electric discharging [sec]

In addition, the present invention is an electron beam apparatus comprising, on a substrate:

a rear plate comprising a plurality of electron-emitting devices comprising a pair of device electrodes, a plurality of first wirings each of which is connected to one of the pair of device electrodes of the electron-emitting device, and a plurality of second wirings c each of which is connected to the other of the pair of device electrodes, wherein the second wirings cross the first wirings sandwiching an insulating layer therebetween; and a face plate, disposed in opposition to the above described rear plate, comprising an anode electrode and a light emitting-member emitting light responsive to an irradiation with an electron emitted from the above described electron-emitting device, wherein an additional electrode electrically connected to either of the above described first wiring or the above described second wiring is provided between adjacent electron-emitting devices, and the additional electrode meets following Formulas (a) to (c).

$$Ee=P\times Cp\times\rho\times Tm \quad (a)$$

$$Ea=R\times I^2\times t_1 \quad (b)$$

$$Ee>Ea \quad (c)$$

P: volume [$m^3$]

Cp: specific heat [J/kgK]

ρ: density [$kg/m^3$]

Tm: melting point [K]

R: resistance [Ω] of an area ranging from a site connected to wiring to an end portion in opposition to the site I: permissible current value [A]

$t_1$: duration of electric discharging [sec]

DETAILED DESCRIPTION OF THE PREFERRED EMBODIMENTS

An electron beam apparatus of the present invention has a rear plate comprising an electron-emitting device as well as wiring for applying voltage to the device and a face plate comprising an anode electrode disposed in opposition to the rear plate. And a feature on a configuration thereof is that an additional electrode meeting following Formulas (a) to (c) is connected electrically to at least one of a set of device electrodes configuring the electron-emitting device.

$$Ee=P\times Cp\times\rho\times Tm \quad (a)$$

$$Ea=R\times I^2\times t_1 \quad (b)$$

$$Ee>Ea \quad (c)$$

P: volume [$m^3$]
Cp: specific heat (at constant pressure) [J/kgK]
ρ: density [$kg/m^3$]
Tm: melting point [K]
R: resistance [Ω]
I: permissible current-value [A]
$t_1$: duration of electric discharging [sec]

As an electron-emitting device used in the present invention, any of an electric field emitting type device, an MIM type device and a surface conduction electron-emitting device can be used. Particularly, from the point of view of discharge being apt to arise, it is applied to an electron beam apparatus generally called a high voltage type to which voltage of not less than several kV is applied.

As follows, the present invention will be described particularly by taking, as an example, an apparatus in use of a surface conduction electron-emitting device preferably used in the present invention.

Figure 6:
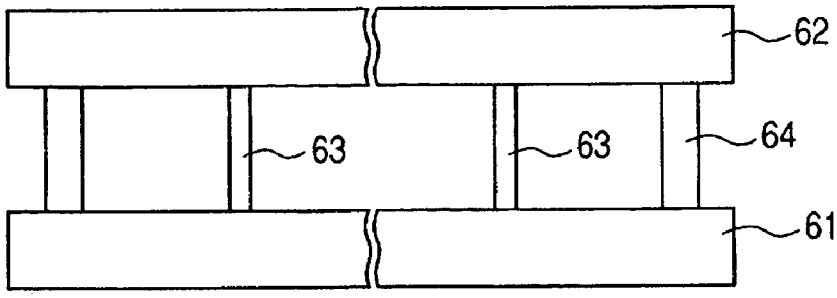
FIG. 6 is a schematic diagram of showing a basic configuration of the present invention.

An electron beam apparatus of the present invention comprises, as a basic configuration, as shown in FIG. 6, a rear plate 61, a face plate 62 disposed in opposition to the rear plate 61, and a frame 64 fixed in the circumference of those plates to configure an outer fence device together with those plates. In addition, it comprises a spacer 63, normally disposed between the rear plate 61 and the face plate 62 to retain distance between those plates and at the same time to function as an atmospheric pressure resistant structure.

Figure 1:
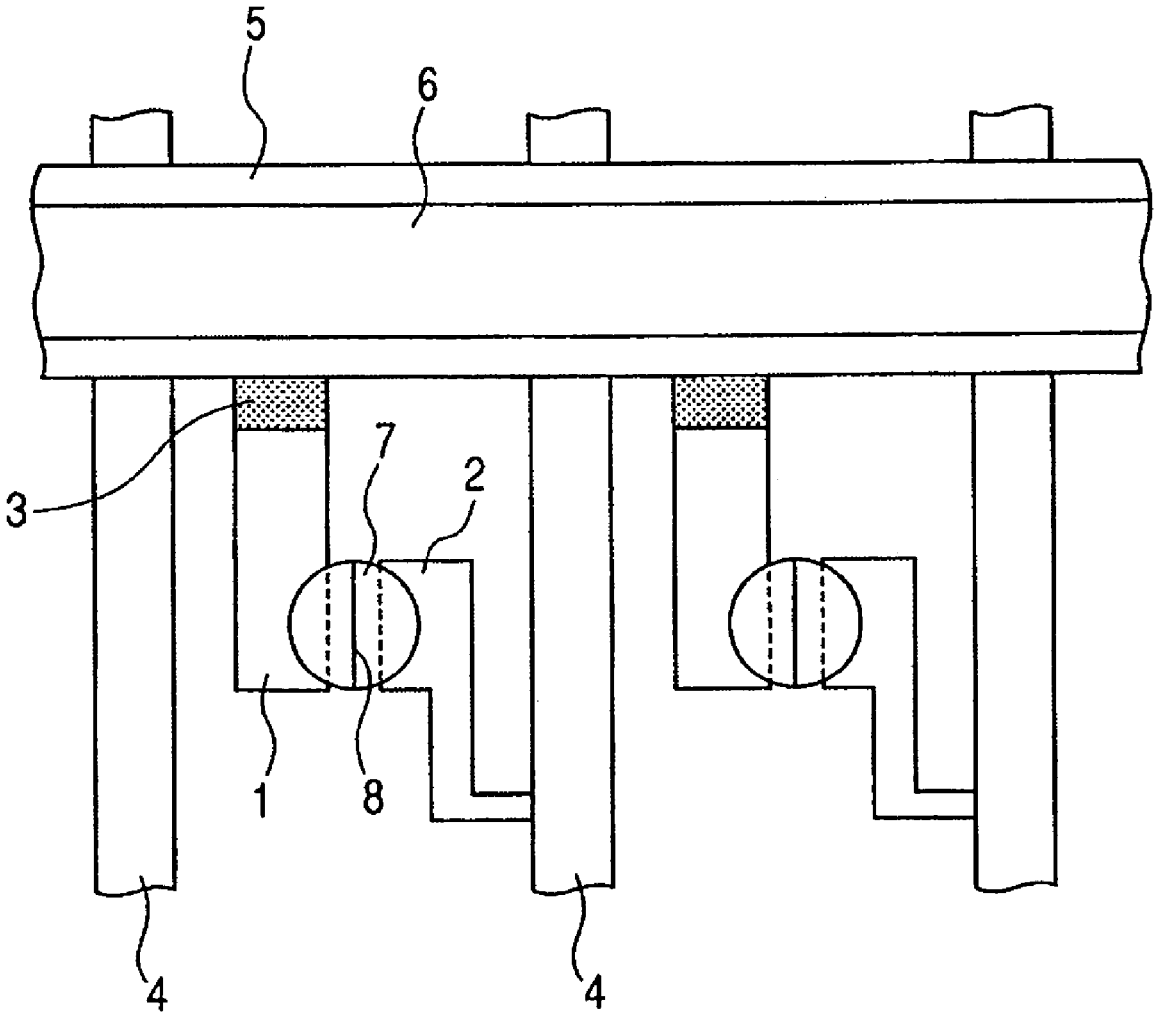
FIG. 1 is a plan diagram schematically showing an electron-emitting device and wiring in a rear plate of an embodiment of the present invention.

FIG. 1 schematically shows a configuration of an electron-emitting device and wiring in a rear plate of a preferable embodiment of an electron beam apparatus of the present invention. In the drawing, reference numeral 1 denotes a scan signal device electrode, reference numeral 2 denotes an information signal device electrode, reference numeral 3 denotes an additional electrode, reference numeral 4 denotes information signal wiring (second wiring), reference numeral 5 denotes an insulating layer, reference numeral 6 denotes scan signal wiring (first wiring), reference numeral 7 denotes device film and reference numeral 8 denotes an electron-emitting portion formed in the device film 7. Here, as shown in FIG. 1, the scan signal device electrode 1 and the information signal device electrode 2 form a pair of device 1 electrodes.

FIGS. 2A to 2E show a process of manufacturing the electron-emitting device and wiring of the rear plate in FIG. 1. Each process will be shown as follows.

Figure 2A:
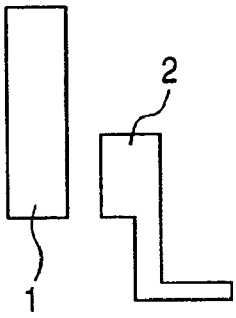
FIGS. 2A, 2B, 2C, 2D and 2E are process diagrams of manufacturing the electron-emitting device and wiring of the rear plate in FIG. 1.

At first, a scan signal-device electrode 1 and an information signal device electrode 2 are formed on a substrate (not shown in the drawing) (FIG. 2A). Those device electrodes 1 and 2 are provided in order to improve electric connection between the wirings 6 and 4 and the device film 7. As a method of forming the device electrodes 1 and 2, a vacuum system such as a vacuum evaporation method, a sputtering method, a plasma CVD method and the like is preferably used. And the device electrodes 1 and 2 are preferably thin film from the point of view of accuracy of electron-emitting device and small step to the device film 7.

Figure 2B:
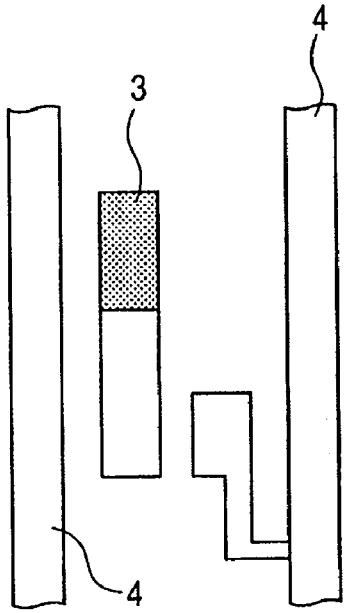

Next, the information signal wiring 4 as well as the additional electrode 3 is formed (FIG. 2B). The additional electrode 3 is connected to the scan signal device electrode 1 and in the present embodiment, the scan signal device electrode 1 and the scan signal wiring 6 are brought into electrical connection with the additional electrode 3. The additional electrode 3 is a part of a scan signal device electrode of bringing the scan signal wiring 6 and the device film 7 into connection, and may be made of the same material, nevertheless has function different from that of the information signal wiring 4 where information signals flow and from the scan signal wiring 6 where scan signals flow. It is necessary to make film thickness of the information signal wiring 4 and the additional electrode 3 thick to increase resistance to current (resistance to heat due to Joule heat). As a forming method, there are thick film printing method of printing and burning thick film paste of mixing Ag component and glass component into solvent and an off-set printing method in use of Pt paste and the like. In addition, it is possible to apply a photo paste method of introducing photolithography technology into the tick film paste printing.

Next, an insulating layer 5 is formed (FIG. 2C) The insulating layer 5 is provided in order to cover the information signal wiring 4 partially and prevent short circuit with the scan signal wiring 6 to be formed thereafter. In addition, in order to secure connection between the additional electrode 3 and the scan signal wiring 6, an orifice of concave type or in a contact hole format is provided. As component material of the insulating layer 5, anything that can retain potential between the information signal wiring 4 and the scan signal wiring 6 will do, being such as insulating thick film paste and photo paste, for example.

Figure 2C:
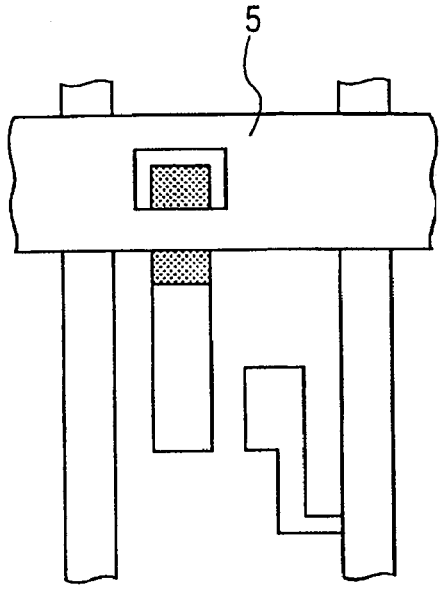
Figure 2D:
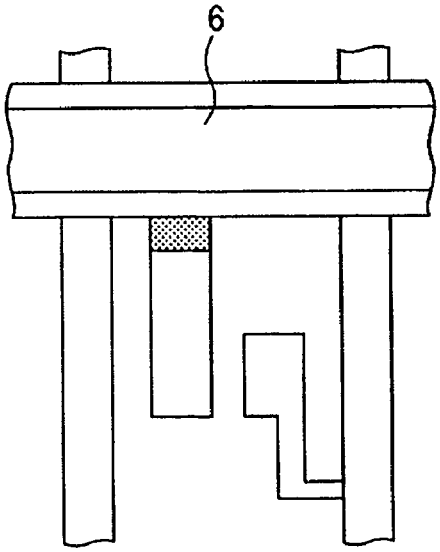

Next, the scan signal wiring 6 is formed (FIG. 2D). As a method of forming the scan signal wiring 6, a method similar to that for the information signal wiring 4 is applicable. In the present embodiment, the scan signal wiring 6 has width wider than that of the information signal wiring 4. Therefore, resistance between the scan signal device electrode 1 and the scan signal wiring 6 is lower than resistance between the information signal device electrode 2 and the information signal wiring 4.

Figure 2E:
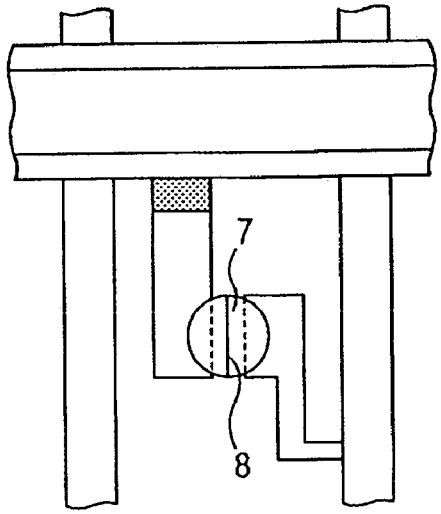

Finally, a device film 7 is formed and an electron discharging portion 8 is formed (FIG. 2E). A representative configuration, a manufacturing method and characteristics of a surface conduction electron-emitting device are disclosed in, for example, Japanese Patent Application Laid-Open No. H02-056822 (U.S. Pat. No. 5,023,110).

In general, discharge inside a panel (outer fence device) is considered to include, mainly, device discharge, foreign substance discharge and protrusion discharge. Device discharge is discharge that arises when an electron-emitting device is destroyed with excess voltage etc., which will act as a trigger. Foreign substance discharge is discharge that arises while the foreign substance, that has commingled inside the panel, is moving. Protrusion discharge is discharge that arises when electron discharge is implemented excessively from an unnecessary protrusion inside the panel.

Figure 3A:
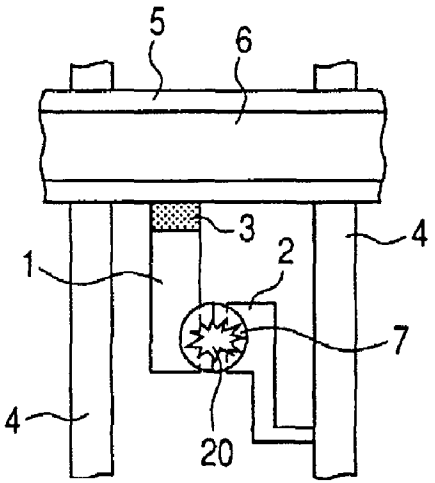
FIGS. 3A, 3B, 3C and 3D are drawings of showing a typical process of progress on discharge.
Figure 3B:
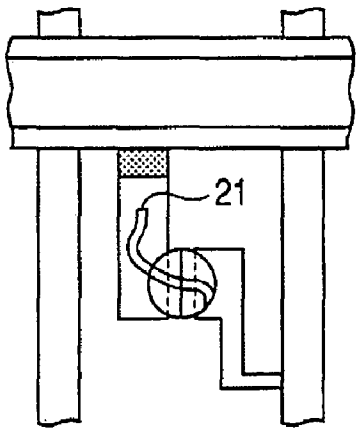

The present invention gives rise to effects for any discharge. In many cases of foreign substance discharge and protrusion discharge, discharge moves to an electron-emitting device or a device electrode (to be described later) after occurrence of discharge to substantially follow a process similar to that of device discharge. Therefore, here, device discharge will be taken as an example for description. FIGS. 3A to 3D show a typical electric discharge propagation process in a device discharge. At first, excess voltage is applied to device film 7 so that a part of the device film 7 is destroyed, and then device discharge 20 arises (FIG. 3A). Triggered thereby, discharge current flows in from the anode electrode so as to proceed with discharge. The discharge current flows from the device film 7 into the device electrodes 1 and 2 connected thereto. At that time, discharge current flows mainly into the scan signal device electrode 1 since the side of the scan signal device electrode 1 has resistance lower than that of the side of the information signal device electrode 2. Therefore, the cathode spot 21 that arises accompanied by discharge also progresses to the scan signal wiring 6 through the scan signal device electrode 1 (FIG. 3B).

Figure 3C:
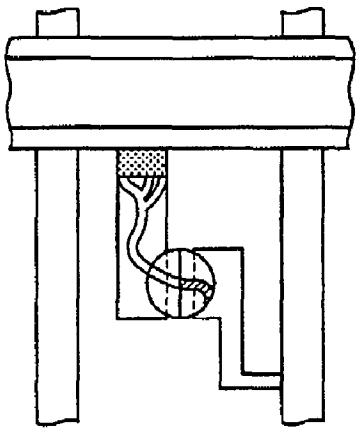
Figure 3D:
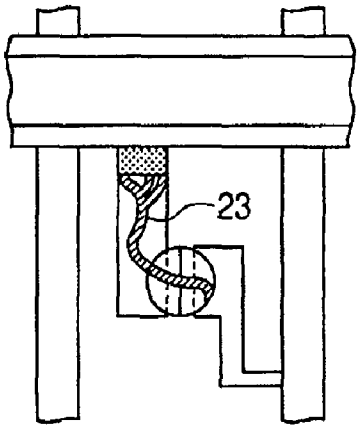

When time lapses further, the cathode spot 21 reaches the additional electrode 3 so that discharge current from the anode electrode flows into the additional electrode 3 directly (FIG. 3C). When all the electric charges stored in the anode electrode-flow, discharge is over. At that time, damage 23 will remain in the scan signal device electrode 1 due to melting of the cathode spot 21 and the device electrode 1 (FIG. 3D).

Though such damaging is remained, since, according to the present invention, the discharge current can be flown through an additional electrode, the moving or propagating the undesirable discharging form one electrode to an adjacent electrode can be prevented. In other word, the present invention provides the electron source comprising the strong and durable electron-emitting devices having an electron structure which can prevent-moving or propagating the discharging form one electron-emitting device to adjacent electron-emitting device.

In order that the additional electrode 3 has sufficient resistance to current, the additional electrode 3 is required to fulfill the following conditions.

$$Ee=P\times Cp\times\rho\times Tm \quad (1), \text{ that is, (a)}$$

$$Eh=\int R\times I_h^2 dt \quad (2)$$

$$Ee>Eh \quad (3)$$

P: volume [$m^3$]

Cp: specific heat (at constant pressure) [J/kgK]

ρ: density [$kg/m^3$]

Tm: melting point [K]

R: resistance [Ω]

$I_h$: discharge current value [A]

The above described Ee is energy that is lost due to melting of the additional electrode 3 while Eh is energy of discharge current flowing into the additional electrode 3. That is, fulfillment of the above described Formula (3) prevents the additional electrode 3 from disappearing during the period when the discharge current flows and allows it to absorb the cathode spot 21 so as to retain electric conduction between the device film 7 and the scan signal wiring 6.

In order to derive the above described Formula (2), it is necessary to measure and obtain-discharge current waveform. However, if the waveform includes high-frequency component, discharge current maximum value $I_m$ might be obtained easily, but the whole waveform will become unclear. Therefore, Formula (2) is replaced by Formula (4).

$$Eh=\int R\times I_h^2 dt\cong R\times I_m^2\times t_1=Et \quad (4)$$

$t_1$: duration of electric discharging

In that case, any discharge waveform will not reach a value exceeding Formula (4). Based on Formula (3), $$Ee>Et \quad (5),$$

then the additional electrode 3 will not disappear, during the period when the discharge current flows but absorb the cathode spot 21 so as to always give rise to completion of conditions of retaining an electric conductive state with the scan signal wiring 6 or the information signal wiring 4.

In the case where the duration of electric discharging $t_1$ cannot be derived by measurement, the following consideration should be taken.

Electric charge amount Q [C] flowing from the face plate to the rear plate at discharge is stipulated with the following Formula (6).

$$Q=C\times V=\int I_h dt \quad (6)$$

C: capacitance between the face plate and the rear plate [F]

V: applied voltage [V]

$$\int I_h dt\cong I_m\times t_1\times 0.5 \quad (7),$$

where $$t_1=2C\times V/I_m \quad (8).$$

Formula (8) derives the duration of electric discharging $t_1$. The reason why multiplication of 0.5 is included in Formula (7) is that discharge current waveform is generally shaped close to triangular wave. Here, as for capacity C between the face plate and rear plate, there is a case that not only the capacity of the whole panel but only a part of capacity contributes to the discharge current in the case where the anode electrode of the face plate is divided and current retaining resistance is inserted as in FIG. 10 to be described later. The value of that partial capacity can be calculated easily by electric circuit-wise calculation from the panel configuration.

Here, a permissible current value I will be defined. The permissible current value I is the maximum value of current capable of flowing in a member with the lowest current resistance among routes where discharge current $I_h$ flows from the scan signal wiring 6 or the information signal wiring 4 to be discharged to outside GND. In the case where discharge current maximum value $I_m$ in excess of the permissible current value I flows, that member will eventually incur discharge damage regardless of presence of the configuration of the present invention, deriving no effect of the present invention.

Therefore, the above described Formulas (4) and (5) are replaced with the following Formulas (9) and (10).

$$Ea=R\times I^2\times t_1 \quad (9), \text{ that is, (b)}$$

$$Ee>Ea \quad (10), \text{ that is, (c)}$$

In the present invention, with $I>I_m$, Formula (10) imposes a condition severer than Formula (3) and Formula (5) does, but in consideration of unstableness of variation of discharge current, it can be regarded as a reasonable condition. Here, Formula (8) is also replaced by the following Formula (11).

$$t_1=2C\times V/I \quad (11)$$

Capacity C in Formula (11) can be replaced by the following Formula (d).

$$t_1=2\epsilon\times S\times V/(D\times I) \quad (d)$$

ϵ: a dielectric constant between the rear plate and the face plate [F/m]

S: facing area of the rear plate and the face plate [$m^2$]

V: a voltage applied between the rear plate and the anode electrode of the face plate [V]

D: distance between the rear plate and the face plate [m]

Figure 4:
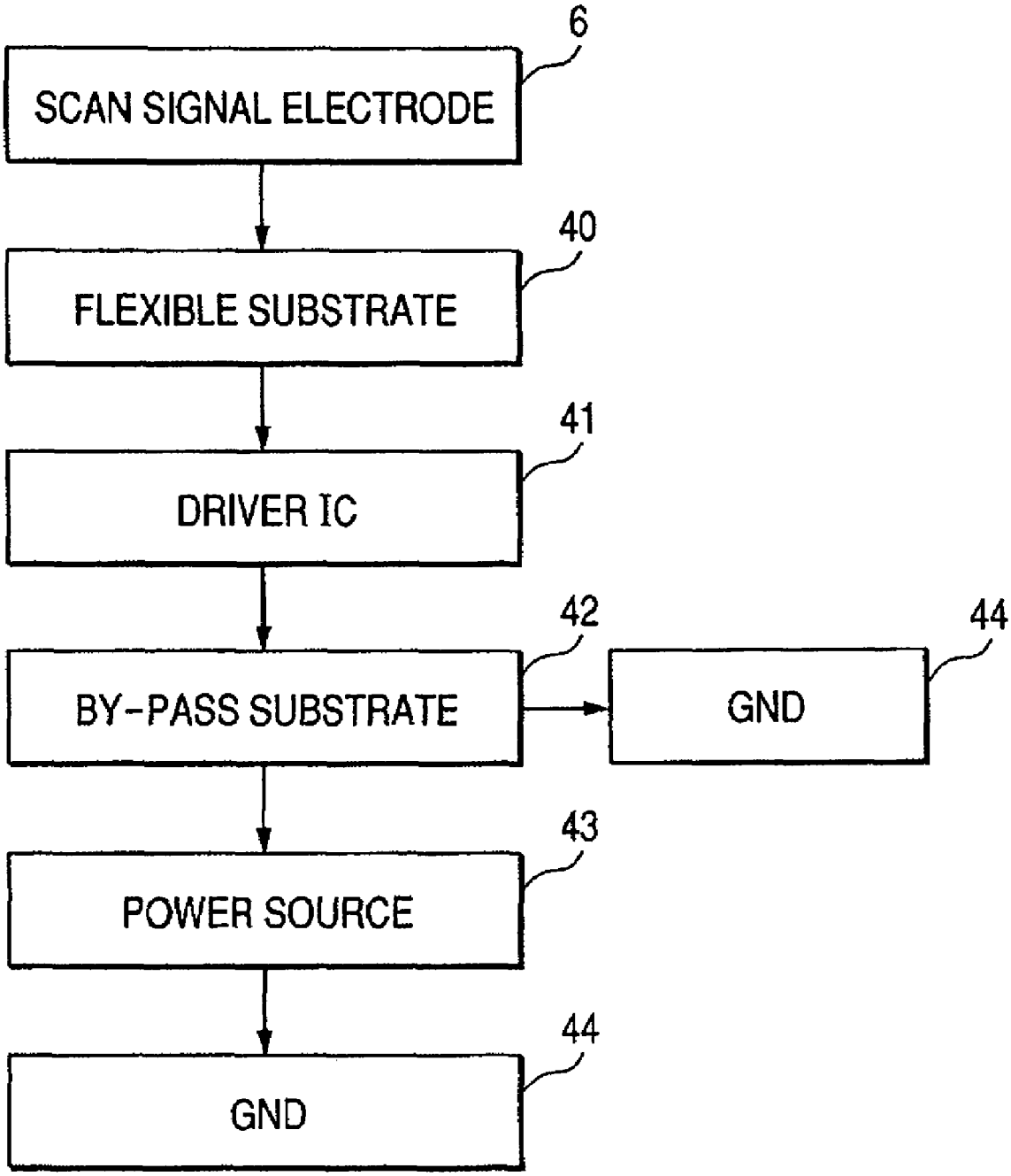
FIG. 4 is a chart showing a schematic route where discharge current is eventually discharged from scan signal wiring to outside GND.

FIG. 4 shows a schematic route up to such a stage that the discharge current $I_h$ is discharged from the scan signal wiring 6 to outside GND. In the drawing, reference numeral 40 denotes a flexible substrate of transmitting scan signals to the wiring 6, reference numeral 41 denotes a driver IC of making drive waveform, reference numeral 42 denotes a by-pass substrate (or driver substrate) of bringing the driver IC 41 and a power source 43, reference numeral 43 denotes a power source of driving the driver IC and reference numeral 44 denotes outside ground (GND). The discharge current $I_h$ flows from the scan signal wiring 6 though the flexible substrate 40 and the driver IC 41 to reach the by-pass substrate 42. The discharge current $I_h$ is a high frequency current, and therefore a major portion thereof flows from the by-pass substrate 42 to the GND 44. A portion flows to the GND 44 through the power source 43. In FIG. 4 the member having the lowest current resistance is the driver IC in general, and in the case where discharge current not less than that arises, the driver is destroyed and line damage takes place. In case of such a configuration, a current value $I_d$ that is caused to flow in the driver IC 41, will become the permissible current value I. Normally, a range of $I_d$ is around 0.01 to 5.0 [A]. Here, there is a case where duration $t_d$ of the current value $I_d$ is designed as a design value of the driver IC 41, and in that case, $t_d$ is replaced by the duration of electric discharging $t_1$.

In addition, in the case where current limited resistance is introduced to the face plate to restrain the discharge current, the discharge current maximum value $I_m$ occasionally gets far smaller compared with $I_d$. In that case, the permissible current value I may be regarded as the discharge current maximum value $I_m$.

In addition, in a thin flat panel display to which high voltage around several kV to over 10 kV is applied, it has been confirmed that discharge tends to spread to an adjacent device at the same time as occurrence of discharge, that is, prior to occurrence of movement phenomena of the cathode spot unless unforeseeable discharge current is restrained to around 2 A. In that case, regardless of capability of the additional electrode, panel destruction due to discharge occurs. Therefore, the permissible current value I is sufficient if it is set to around 3 A. In this regard, in case of introducing current limited resistance into the face plate, the discharge current maximum value $I_m$ is restrained to around 0.1 to 3.0 A. For example, it is realized by dividing the anode electrode and using high resistant member having current limited resistance. The anode electrode is divided into strips with width of several tens to several 100s μm or into a dot state and a member of current limited resistance of several 100s to several MΩ/□ is used to derive the above described value. The design value can be derived easily by calculating capacitance and resistance value from a model with the above described configuration and by using circuit calculation etc. by SPICE. Like that, the permissible current value I in consideration of the driver IC and the configuration of the flat panel display, etc. may be around 0.1 to 3.0 A as well.

As described above, the additional electrode 3 is formed to have film thickness thicker or have width wider than the scan signal device electrode 1 to increase resistance to current, and then discharge current can be caused to flow in the scan signal wiring 6 without incurring breaking. Therefore, surface creeping discharge accompanied by melting and breaking of the device electrode 1 can be restrained.

As apparent from the process of progress on discharge in FIGS. 3A to 3D, location of the additional electrode 3 is important as well. In case of device discharge in FIGS. 3A to 3D, due to retention of the cathode spot 21 at an end portion of the insulating layer 5 the closest to the scan signal wiring 6 of the scan signal device electrode 1, the additional electrode 3 having resistance to current is required to be disposed in that location. Since the end portion of the insulating layer 5 above the scan signal device electrode 1 will become a so-called triple junction, it is important for the additional electrode 3 to contact the scan signal device electrode 1 at the end portion of the insulating layer 5 electrically in order to protect that portion. Moreover, it is preferable that the end portion of the insulating layer 5 covers the whole surface of the scan signal device electrode 1. In addition, the end portion of the insulating layer 5 to the scan signal wiring 6 is brought into connection with the additional electrode 3, risk of breaking in somewhere midway will be deprived, which is more preferable.

In addition, the additional electrode 3 may be configured to be added to a side of either of the scan signal device electrode 1 or the information signal device electrode 2 where resistance from the electron-emitting portion 8 through and end of the scan signal wiring 6 or the information signal wiring 4 to the GND is lower. The reason thereof is, as having been shown in the present embodiment, the cathode spot 21 hardly progresses on the high resistance side.

In the present embodiment, the information signal device electrode 2 is connected with the information signal wiring 4 directly, and no additional electrode is provided. However, in such a configuration that the information signal device electrode 2 is covered with the insulating layer 5, an additional electrode may be disposed in the information signal device electrode 2 at the end portion of the insulating layer 5.

In addition, by providing the device electrodes 1 and 2, to which additional electrodes are provided, with a site (kink portion) where resistance varies discontinuously in the vicinity of the additional electrodes, and the cathode spot 21 can be controlled thereby more effectively. FIGS. 5A to 5D show a process of progress on device discharge in the case where the kink portions are provided. In FIGS. 5A to 5D, the sites where electrode width of the scan signal device electrode 1 varies are the kink portions 51. Here, the like reference numerals are given to the like members in FIGS. 3A to 3D and descriptions thereof will be omitted.

Figure 5A:
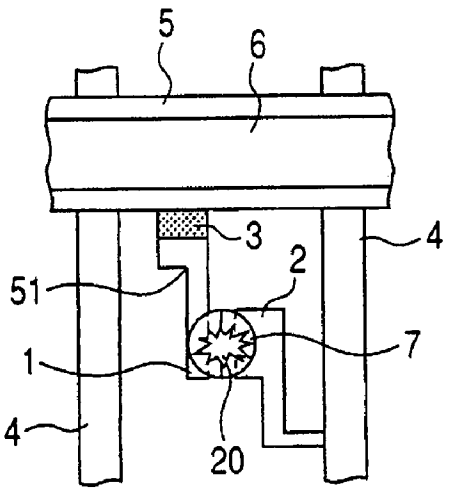
FIGS. 5A, 5B, 5C and 5D are drawings of showing a process of progress on device discharge in the case where a kink portion is provided in a scan signal device electrode.
Figure 5B:
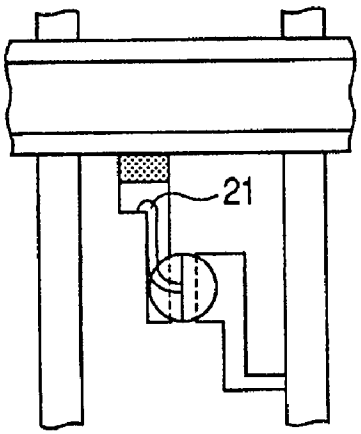
Figure 5C:
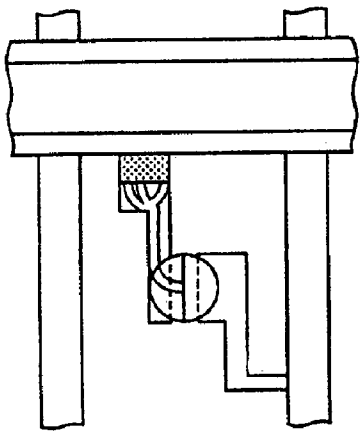
Figure 5D:
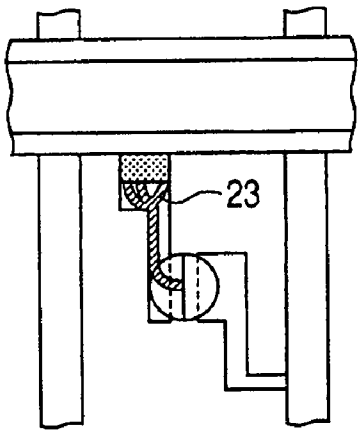

When excess voltage is applied to the device film 7 and a portion of the device film 7 is destroyed, device discharge 20 arises (FIG. 5A). Being triggered thereby, discharge current flows in from the anode electrode. The cathode spot 21 arising accompanied by discharge progresses to the scan signal wiring 6 in the scan signal device electrode 1. At that time, current concentration takes place in the kink portion 51, melting starts at a stage earlier than in another place so that the cathode spot 21 moves to the kink portion 51 (FIG. 5B). And the cathode spot 21 progresses from the kink portion 51 to the additional electrode 3 (FIG. 5C). When the charges accumulated in the anode electrode are consumed, discharge comes to an end. At that time, damage 23 remains in the scan signal device electrode 1 due to the cathode spot 21 and melting of the scan signal device electrode 1 (FIG. 5D). Like that, presence of the kink portion 51 enables fast movement of the cathode spot 21 to the additional electrode 3. The kink portion 51 will not be limited in particular on its shape, but normally can be formed by causing electrode width and electrode thickness to vary.

In addition, in case of configuring one pixel with a plurality of electron discharge devices, the surface creeping discharge threshold value is lower than that in case of configuring one pixel with one electron-emitting device, and therefore the effect of the present invention is derived more remarkably.

EXAMPLES

The present invention will be described in detail with specific examples as follows, but the present invention will not be limited to modes of those examples.

Example 1

A rear plate configured as shown in FIG. 1 has been produced in accordance with processes shown in FIGS. 2A to 2E. In the present example, for a substrate, glass with thickness of 2.8 mm of PD-200 (produced by Asahi Glass Co., Ltd.) with few alkali components and moreover $SiO_2$ film with film thickness of 100 nm has been coated to form a sodium block layer on that glass substrate.

Forming of Device Electrode

Pt film with film thickness of 20 nm was formed with a sputtering method onto the above described glass substrate. Thereafter, photoresist was coated over the whole surface, and subject to patterning with a series of photolithography technology of exposure, development and etching, a scan signal device electrode 1 and an information signal device electrode 2 were formed (FIG. 2A). Electric resistivity of those device electrodes 1 and 2 was $0.25\times10^{-6}$ [Ωm]. In addition, the scan signal device electrode 1 was shaped to have width of 30 μm and length of 150 μm.

Forming of Information Signal Wiring and Additional Electrode

Subject to screen printing with silver Ag photo paste ink, drying and exposure to a predetermined pattern, development was implemented. Thereafter, subject to burning at approximately 480° C., information signal wiring 4 and an additional electrode 3 were formed (FIG. 2B). The additional electrode 3 was shaped to have thickness of approximately 10 μm, width of 30 μm and length of 150 μm to cover the device electrode 1 partially in the longitudinal direction. The information signal wiring 4 was shaped to have thickness of approximately 10 μm and width of 20 μm. Electric resistivity of the produced additional electrode 3 was measured to derive $0.03\times10^{-6}$ [Ωm]. Here, the end portion of the additional electrode 3 (a side not covering the device electrode 1) is used as an extracting electrode of the scan signal wiring 6, and therefore was formed to have large width.

Forming of Insulating Layer

Photo sensitive paste with PbO as the main component underwent screen printing under the scan signal wiring 6 to be formed in the post-process, exposure, development and lastly burning at approximately 460° C. so that an insulating layer 5 with thickness of 30 μm and width of 200 μm was formed (FIG. 2C). The insulating layer 5 was provided with an orifice in a region corresponding to the end portion of the additional electrode 3.

Forming of Scan Signal Wiring

Ag paste ink underwent screen printing, drying and thereafter burning at around 450° C. to form a scan signal wiring 6 with thickness of 10 μm and with width of 150 μm on the above described insulating layer 5 (FIG. 2D). Here, in the process hereof, pullout wiring as well as pullout terminal to an outside drive circuit was formed likewise. In the present example, the additional electrode 3 and the scan signal wiring 6 are brought into direct connection, and the scan signal device electrode 1 is covered over the whole surface by the additional, electrode 3 in the end portion of the insulating layer 5.

Resistance of wiring group of the present example was measured to find that resistance from the scan signal device electrode 1, where the device film 7 was formed, through the scan signal wiring 6 to an outside drive circuit was approximately 70Ω and resistance from the information signal device electrode 2 through the information signal wiring 4 to an outside drive circuit was approximately 700Ω.

Forming of Device Film and Electron-Emitting Portion

The above described substrate was cleaned sufficiently, thereafter underwent processing on its surface with a solution containing a water repellent agent and was made hydrophobic. Palladium-proline complex was solved into-mixed solution of water and isopropyl alcohol (IPA) with proportion of 85:15 (v/v) to derive content amount of 0.15 mass % in the solution to prepare organic palladium containing solution. The above described organic palladium containing solution was prepared to form dots with diameter of 50 μm by an ink jet coating apparatus in use of piezo device and was added between the above described scan signal device electrode 1 and information signal device electrode 2. Thereafter, heating and burning process was implemented at 350° C. in the air for 10 minutes to derive oxide palladium (PdO) film of maximum thickness of 10 nm.

The above described oxide palladium film underwent electroheating under vacuum atmosphere containing a little hydrogen gas to reduce the oxide palladium to form the device film 7 made of palladium and form the electron-emitting part 8 in a portion of the device film 7.

Subsequently, trinitrile was introduced to the vacuum atmosphere so that the above described device film 7 underwent electroprocessing in a vacuum atmosphere of $1.3\times10^{-4}$ Pa and carbon or carbon compound was deposited in the vicinity of the electron-emitting part.

Forming of Display Panel

The rear plate derived as described above and the face plate configured by laminating phosphor film as light emitting member and metal back as anode electrode on the glass substrate were provided with a frame disposed in the circumference as shown in FIG. 6 so as to keep distance between the plates with a spacer to 2 mm and were sealed. A display panel derived like that had pixel amount of 3072×768 and pixel pitch of 200×600 μm. The permissible current value $I_d$ of the scan driver of the present example was set to 5 A.

In addition, as a Comparative Example 1, a display panel with the same configuration except that the additional electrode 3 is not provided was produced.

Assessment

The display panels of Example 1 and Comparative. Example 1 derived as described above were caused to display images as usual, and then good display was derived with any display panel.

Subsequently, in order to confirm effects of the present invention, excess voltage was applied to the electron-emitting device to implement a discharge experiment of intentionally inducing device discharge. At first, electron-emitting devices other than those equivalent to a pixel at an approximate address (X, Y) located apart from the spacer at the center of the panel and 3 pixels were removed. The reason of that arrangement is that, if electron-emitting devices are brought into connection on wiring to be driven in the discharge experiment, current corresponding with device characteristics will be eventually added to discharge current at the time of applying a voltage. As a method of removing the electron-emitting devices, it was realized by irradiating a YAG laser to the device film 7 from the rear face of the rear plate. The device film 7 is extremely thin film, and therefore is removable with a low output.

Next, a voltage of 3 kV was applied to the anode electrode of the face plate, and −17 V and +17 V were applied thereto as scan signal and information signal respectively. At the same time, with a voltage probe and a current probe, waveform of voltage and current of the voltage applying line was monitored.

Figure 7:
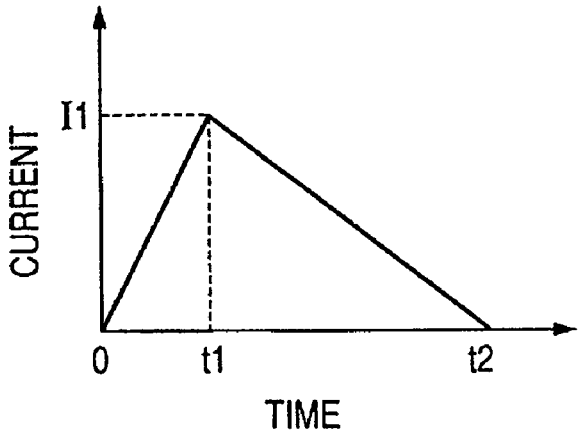
FIG. 7 is a graph showing waveform of discharge current outputted from the scan signal wiring in an embodiment.

In the present example, scan signal side has resistance of the voltage applying route lower than that of the information signal side, the major part of the discharge current flows to the scan signal wiring. Electric circuit-wise, shunt current proportion of scan signal side: information signal side=10:1 is derived, but as having been shown in. FIGS. 3A to 3D, the cathode spot 21 moves on the scan signal device electrode 1 so that the device film 7 was destroyed to become high resistance, and therefore, current to flow on the information signal side may be regarded to be zero. Actually, discharge current from the information signal wiring 4 was not more than 20 mA. FIG. 7 shows a schematic graph of the discharge current waveform outputted from the scan signal wiring 6 of the present example. In the present example, the current I(1) in FIG. 7 was 4 A, the time t(1) was 0.2 μsec and the time t(2) was 0.8 μsec. Here, in the comparative example, no stable measurement of discharge current was feasible.

Subject to the discharge experiment, pixel damage was observed to find that only pixels in the display panel in Example 1 where discharge took place were damaged by device discharge, and in contrast, in the display panel in Comparative Example 1, device discharge damage also reached one adjacent pixel along the scan signal wiring 6.

Here, in configurations of the scan signal device electrode and the additional electrode of the present Example will be confirmed in accordance with Formulas (a) to (c). Here, the permissible current value is set to the scan driver's permissible current value $I_d$=5 A.

<Configuration of Example 1>

Additional electrode (Ag):

$$P=(10\times30\times150)\times10^{-18}=4.5\times10^{-14}\ [m^3]$$

Cp=230 [J/kgK]

$\rho=1.05\times10^4$ [kg/m$^3$]

Tm=1235 [K]

From Formula (a), $$Ee_1=P\times Cp\times\rho Tm=1.3\times10^{-4}\ [J]$$

Electric resistivity is $0.03\times10^{-6}$ [Ωm], and therefore, $$R_1=0.03\times10^{-6}\times150\times10^{-6}/(10\times10^{-6}\times30\times10^{-6})=0.015\ [\Omega]$$

from Formula (b), $$Ea_1=R_1\times I_d^2\times t(2)=0.015\times25\times0.8\times10^{-6}=3.0\times10^{-7}\ [J]$$

Therefore, $Ee_1 >> Ea_1$

<Configuration of Comparative Example 1>

Scan signal device electrode (Pt):

$$P=(0.02\times30\times150)\times10^{-18}=9.0\times10^{-17}\ [m^3]$$

Cp=120 [J/kgK]

$\rho=2.14\times10^4$ [kg/m$^3$]

Tm=2045 [K]

From Formula (a), $$Ee_{c1}=P\times Cp\times\rho\times Tm=4.7\times10^{-7}\ [J]$$

Electric resistivity is $0.25\times10^{-6}$ [Ωm], and therefore, $$R_{c1}=0.25\times10^{-6}\times150\times10^{-6}/(2\times10^{-8}\times30\times10^{-6})=62.5\ [\Omega]$$

from Formula (b), $$Ea_{c1}=R_{c1}\times I_d^2\times t(2)=62.5\times25\times0.8\times10^{-6}=1.3\times10^{-3}\ [J]$$

Therefore, $Ee_{c1} << Ea_{c1}$

As described above, while the display panel of Example 1 is provided with the additional electrode fulfilling Formula (c), the display panel of Comparative Example 1 is not provided with any additional electrode and the scan signal device electrode does not fulfill Formula (c).

Here, as for the duration of electric discharging $t_1$, from Formula (12), a likewise result is also derived with the following $$\begin{aligned} t_1 &= 2\varepsilon\times S\times V/(d\times I) \\ &= 2\times8.85\times10^{-12}\times(3072\times200\times768\times600\times10^{-12})\times3000/(2\times10^{-3}\times5) \\ &= 1.5\times10^{-6}[\mu\text{sec}] \end{aligned}$$

Example 2

Figure 8:
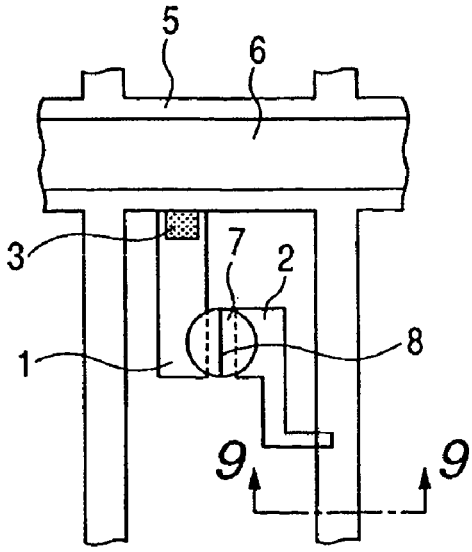
FIG. 8 is a plan diagram of schematically showing a configuration of pixels of a rear plate produced in Embodiment 2.

As shown in FIG. 8, a rear plate was produced to have the same configuration as that in Example 1 except that width of the additional electrode 3 is narrower than that of the scan signal device electrode 1 and the insulating layer 5 covers the information signal wiring 4. Here, as described above, the information signal wiring is covered by the insulating layer 5, and therefore is now shown in FIG. 8.

Figure 9:
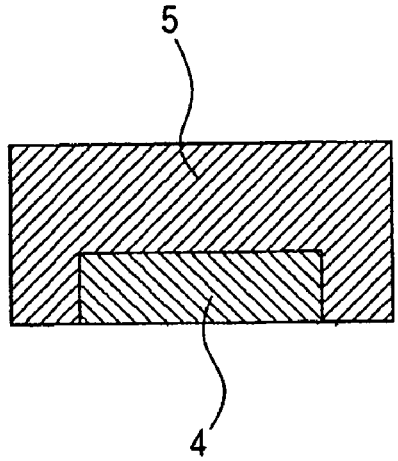
FIG. 9 is a sectional schematic diagram in a longitudinal direction of information signal wiring in FIG. 8.

The additional electrode 3 of the present example was shaped to have thickness of approximately 5 μm, width of 20 μm and length of 150 μm. In addition, the insulating layer 5 extended on the information signal wiring 4 was shaped to have width of 30 μm. FIG. 9 shows a sectional view cut along 9-9 in FIG. 8. Here, in the present example, the information signal wiring 4 is covered by the insulating layer 5, but resistance of the scan signal side to GND is 10 times lower than that of the information signal side to GND so that discharge current flows to the scan signal side, and therefore, the information signal device electrode 2 may be provided with no additional electrode.

Figure 10:
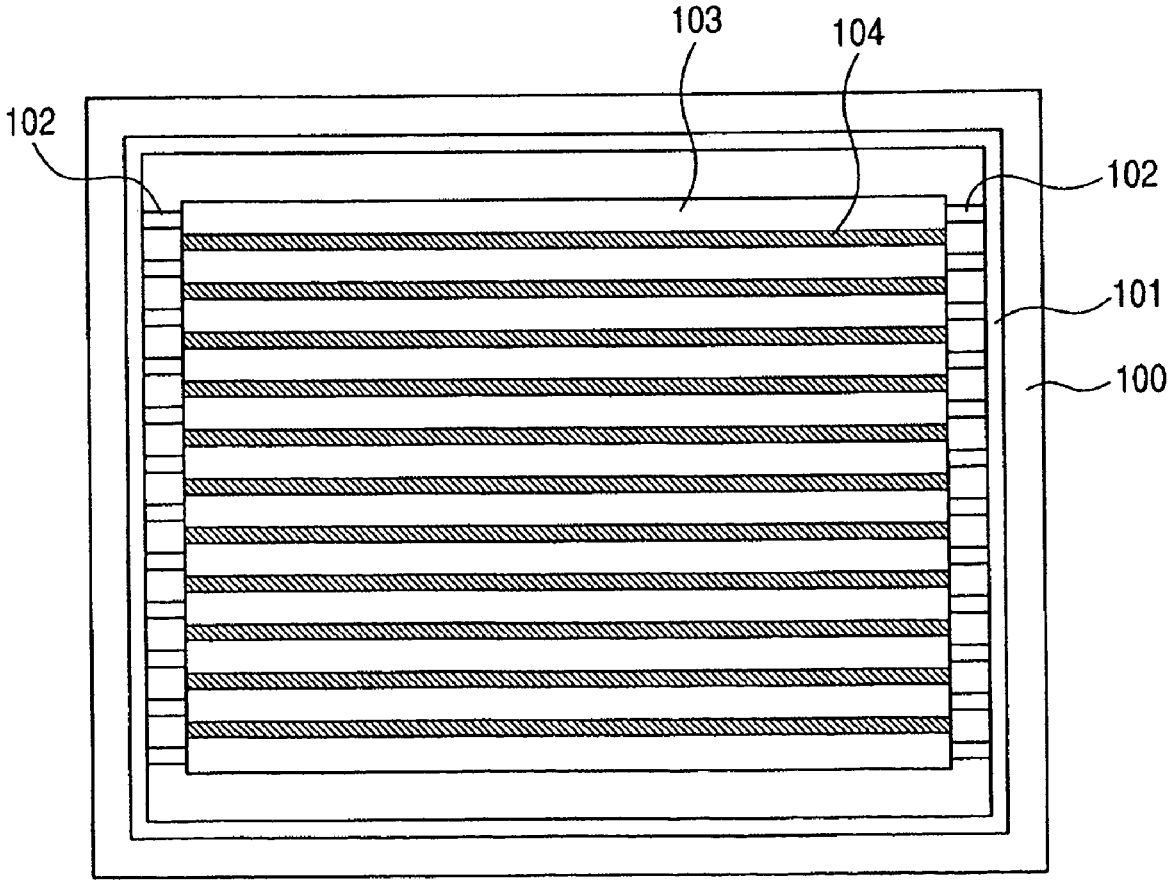
FIG. 10 is a plan diagram of schematically showing a configuration of a face plate produced in Embodiment 2.

FIG. 10 schematically shows a plan configuration of a face plate used in the present example. In the drawing, reference numeral 100 denotes a glass substrate, reference numeral 101 denotes a common electrode, reference numeral 102 denotes electrode-to-electrode resistance, reference numeral 103 denotes metal back being an anode electrode and reference numeral 104 denotes a black stripe. A process of producing the present face plate will be described as follows.

At first, subject to screen printing onto the glass substrate 100 with Ag photo paste, drying and exposure to a predetermined pattern, development was implemented to form the common electrode 101. Next, electrically conductive black matrix material, underwent screen printing, exposure and development to a predetermined pattern so that the electrode-to-electrode resistance 102 was formed. Subsequently, with the electrically conductive black matrix material different from the electrode-to-electrode resistance 102, the black stripe 104 was formed with screen printing. Fluorescent substance was printed (not shown in the drawing, and was formed between the metal back 103 and the glass substrate 100) onto the pixel portion and the surface of the fluorescent substance underwent filming processing and aluminum film underwent patterning with a metal mask so that the metal back 103 was formed. The metal back 103 is an electrode shaped as a line along the scan signal wiring 6 to have width of 400 μm. Lastly, face plate was burned at approximately 500° C.

The resistance value of the electrode-to-electrode resistance 102 of the such formed face plate was found to be 200 kΩ between the common electrode 101 and the metal back 103 while the resistance value between the black stripe 104 and the metal back 103 was 20 kΩ. Electric circuit-wise consideration has made it apparent that little charge flows in from the common electrode 101 in the case where discharge occurs at a metal back 103 at the time when an anode voltage of several kV is applied, and only charge around several lines of metal backs 103 attributes to discharge.

With the above described rear plate and face plate, a matrix display panel with pixel amount of 3840×768 and pixel pitch of 200×600 μm was derived. In addition, a display panel of Comparative Example 2 was produced to have a configuration similar to that in Example 2 except that no additional electrode is provided.

Assessment

A display panels in Example 2 and Comparative Example 2 underwent discharge experiments. A voltage of 10 kV was applied to the metal back 103 and −15 V and +15 V were applied thereto as scan signal and information signal respectively. At the same time, with a voltage probe and a current probe, waveform of voltage and current of the voltage applying line was monitored.

The discharge current waveform outputted from the scan signal wiring 6 of the present example was the waveform shown in FIG. 7 likewise that in Example 1, and in the present example, the current I(1) was 1 A, the time t(1) as 0.15 μsec and the time t(2) was 0.4 μsec. In addition, as a result of current and voltage measurement on the face plate side, 10 lines among the metal backs 103 were found to attribute to discharge current. In addition, discharge current flowing in on the side of the information signal wiring 4 was not more than 20 mA.

Subject to the discharge experiment, pixel damage was observed to find that only pixels in the display panel in Example 2 where discharge arose were damaged by device discharge, and in contrast, in the display panel in Comparative Example 2, device discharge damage also reached one adjacent pixel along the scan signal wiring 6.

Here, in configurations of the scan signal device electrode and the additional electrode of the present Example will be confirmed in accordance with Formulas (a) to (c). Here, the permissible current value is set to the actual discharge-current maximum amount. I(1)=1 A.

<Configuration of Example 2>

Additional electrode (Ag):

$$P=(5\times20\times150)\times10^{-18}=1.5\times10^{-14}\ [m^3]$$

Cp, ρ, Tm are the same as those in Example 1.

From Formula (a), $$Ee_2=P\times Cp\times\rho\times Tm=4.5\times10^{-5}$$

Electric resistivity is $0.03\times10^{-6}$ [Ωm], and therefore, $$R_2=0.03\times10^{-6}\times150\times10^{-6}/(5\times10^{-6}\times20\times10^{-6})=0.045\ [\Omega]$$

from Formula (b), $$Ea_2=R_2\times I(1)^2\times t(2)=0.045\times1\times0.4\times10^{-6}=1.8\times10^{-8},\text{ and}$$

therefore, $Ee_2 >> Ea_2$

<Configuration of Comparative Example 2>

Scan signal device electrode (Pt):

The configuration is the same as that in Example 2, and therefore, $$Ee_{c2}=P\times Cp\times\rho\times Tm=4.7\times10^{-7}$$

$$Ea_{c2}=R_{c1}\times I(1)^2\times t(2)=62.5\times1\times0.4\times10^{-6}=2.5\times10^{-5}$$

Therefore, $Ee_{c2} << Ea_{c2}$

As in case of Example 1, while Example 2 is equipped with the additional electrode fulfilling Formula (c), Comparative Example 2 lacks an additional electrode and the scan signal device electrode does not fulfill Formula (c). In addition, as in the present example, the information signal wiring 4 is covered with the insulating layer 5 and thereby discharge current is restrained to flow in to the information signal wiring 4 and damage to the adjacent pixel can be prevented.

Example 3

Figure 11:
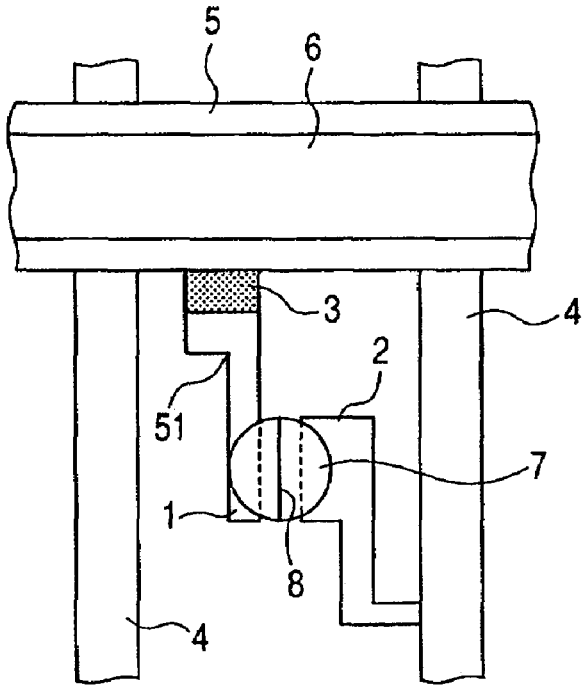
FIG. 11 is a plan diagram of schematically showing a configuration of pixels of a rear plate produced in Embodiment 3.

As shown in FIG. 11, a display panel was produced as in Example 1 except that a kink portion 51 was formed in the scan signal device electrode 1. The scan signal device electrode 1 of the present example was shaped to have width of 10 μm and length of 80 μm in the portion contacting the device film 7 and width of 30 μm and length of 100 μm in the portion contacting the additional electrode 3. The pixel amount was set to 3072×768 and pixel pitch was set to 200×600 μm.

As prior consideration, current with waveform of a triangular wave was applied (a probe was brought into contact with the scan signal wiring 6 and the device film 7) to the scan signal device electrode 1 in the present Embodiment 3 and the scan signal device electrode 1 in the present Embodiment 1 to, confirm device electrode damage. As a result thereof, the cathode spot in the scan signal device electrode 1 in Example 1 moved to the additional electrode 3 at approximately 300 mA while the cathode spot in the scan signal device electrode 1 in Example 3 moved to the additional electrode 3 at approximately 150 mA. That is, provision of the kink portion 51 enables discharge current to flow in to an additional electrode with lower current to restrain potential increase and prevent surface creeping discharge.

Assessment

As in Example 1, a display panel of the present example underwent discharge experiment. A voltage of 3 kV was applied to the anode electrode, and −17 V and +17 V were applied thereto as scan signal and information signal respectively. Subject to the discharge experiment, pixel damage was observed to find that only pixels in the display panel in the present example where discharge arose were damaged by device discharge, and no damage to the adjacent pixel was observed. Here, since it is apparent that the additional electrode of the present example fulfills Formula (c) as in Example 1, the related description will be omitted.

Example 4

Figure 12:
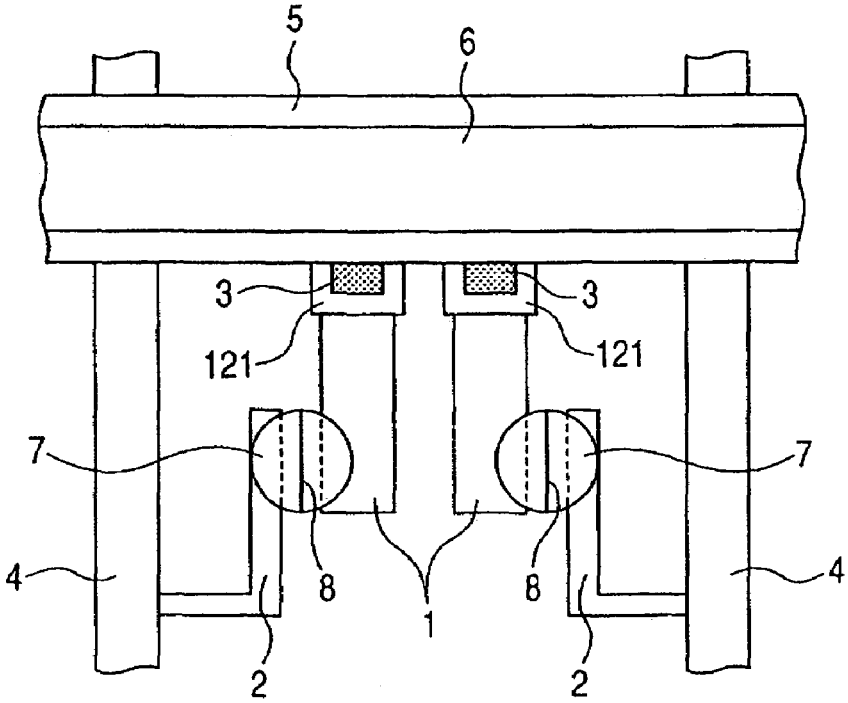
FIG. 12 is a plan diagram of schematically showing a configuration of pixels of a rear plate produced in Embodiment 4.
Figure 13A:
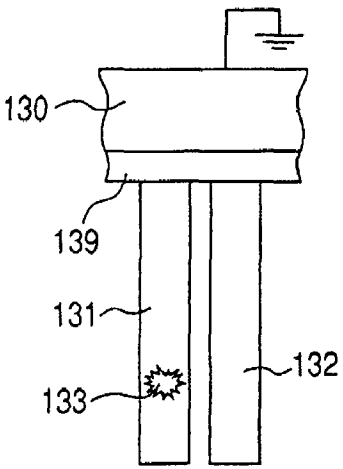
FIGS. 13A, 13B, 13C, 13D, 13E and 13F are explanatory diagrams of surface creeping discharge.
Figure 13B:
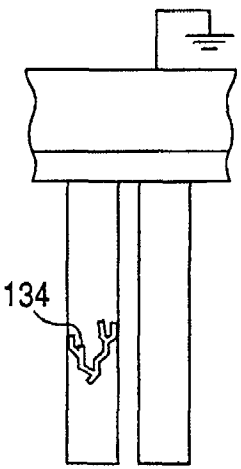
Figure 13C:
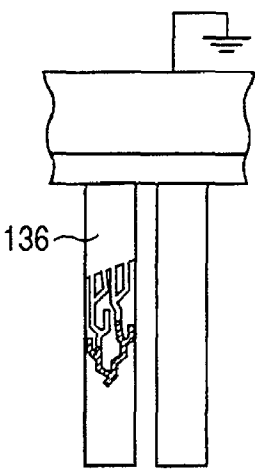
Figure 13D:
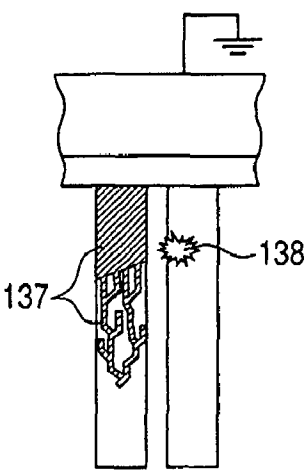
Figure 13E:
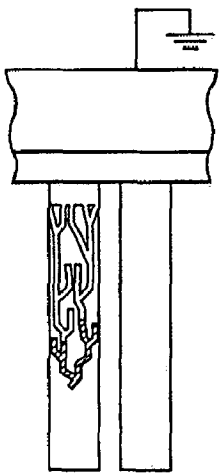
Figure 13F:
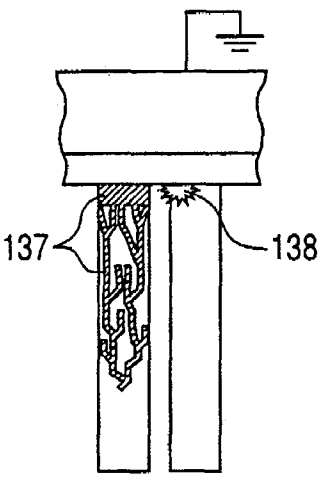

As shown in FIG. 12, a display panel was produced as in Example 1 except that a display panel having two electron-emitting devices in one pixel and provided with a barrier layer 121 between the additional electrode 3 and the scan signal device electrode 1. Here, that display panel was set to have the pixel amount of 3072×768 and pixel pitch of 200×600 μm.

The barrier layer 121 is caused to intervene between the both parties so as not to change resistance characteristics due to diffusion of Ag being component material of the additional electrode 3 into the scan signal device electrode 1 configured by Pt. The barrier layer 121 underwent vacuum film forming with a reactive sputtering while $O_2$ is being introduced with ITO as a target so as to be formed to a desired patterned with photolithography. It, was shaped to have film thickness of 0.2 μm, width of 40 μm and length of 190 μm.

Assessment

As in Example 1, a display panel of the present example underwent discharge experiment. A voltage of 3 kV was applied to the anode electrode, and −17 V and +17 V were-applied thereto as scan signal and information signal respectively. Subject to the discharge experiment, pixel damage was observed to find that only pixels in the display panel in the present example where discharge arose were damaged by device discharge, and no damage to the adjacent pixel was observed. Here, since it is apparent that the additional electrode of the present example fulfills Formula (c) as in Example 1, the related description will be omitted.

Figure 14A:
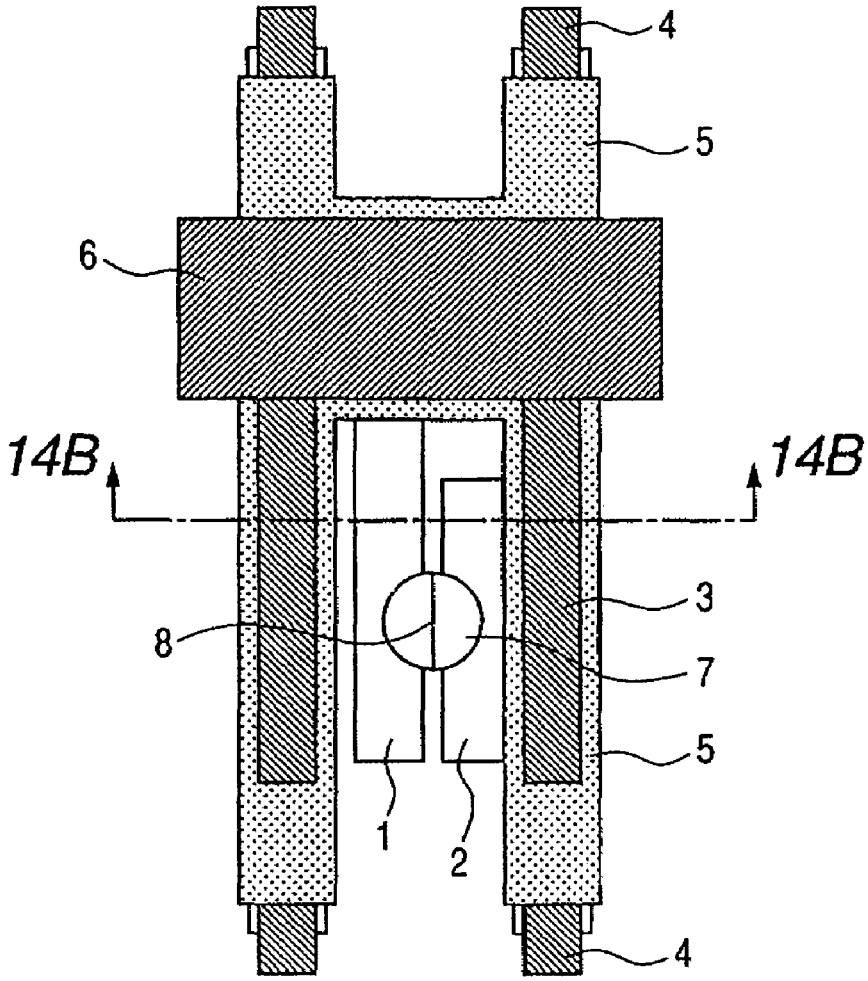
FIGS. 14A and 14B are diagrams of schematically showing a configuration of a pixel of a preferable embodiment of the present invention.
Figure 14B:
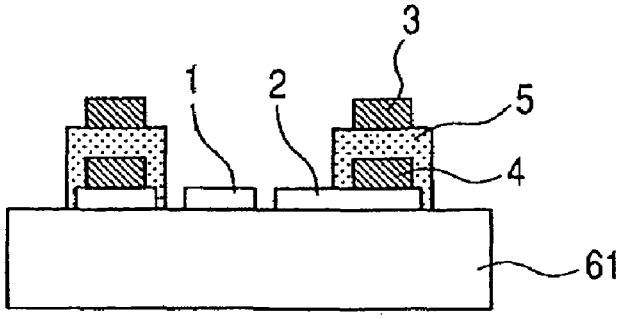

Next, a configuration where an additional electrode is disposed between adjacent electron-emitting devices will be described. Here, the same part numeral will be given to the likewise members in the above described examples for description. In addition, also in the subsequent configurations, respective members can be manufactured with the same method as in the above described examples, description on the manufacturing process will be omitted as well. FIGS. 14A and 14B are drawings of schematically showing a pixel of a rear plate of an image forming apparatus of the present invention, FIG. 14A being a plan diagram, FIG. 14B being a sectional diagram cut along the 14B-14B' line in FIG. 14A. In the drawing, reference numeral 1 denotes a scan signal device electrode, reference numeral 2 denotes an information signal device electrode, reference numeral 3 denotes an additional electrode, reference numeral 4 denotes information signal wiring (second wiring), reference numeral 5 denotes an insulating layer, reference numeral 6 denotes scan signal wiring (first wiring), reference numeral 7 denotes device film, reference numeral 8 denotes an electron-emitting portion formed in the device film 7 and reference numeral 61 denotes a substrate.

With the additional electrode 3 in the present configuration being disposed between adjacent electron-emitting devices, function thereof rests on shielding and absorbing secondary discharge arising by primary discharge arising between the anode and one electron-emitting device flying to reach the other electron-emitting device in the secondary discharge route.

In a configuration in FIGS. 14A and 14B, the additional electrode 3 was disposed in such a position so that any straight line route bringing the device electrodes 1, 2 and the device film 7 of the adjacent electron-emitting-devices into connection is intercepted in a direction with shorter distance between the adjacent electron-emitting devices (normally in a direction in parallel to the scan signal wiring 6). Thereby, the additional electrode 3 can prevent the secondary discharge (surface creeping discharge) arising so as to bring the electron-emitting portion 7 being apt to become a site where the primary discharge arising between the anode electrode and the electron-emitting device and the electron-emitting portion 8 of the adjacent device being apt to become a flight destination of that discharge into connection. And the additional electrode 3 absorbs the secondary discharge so as to enable prevention of damage to the adjacent devices.

Figure 15A:
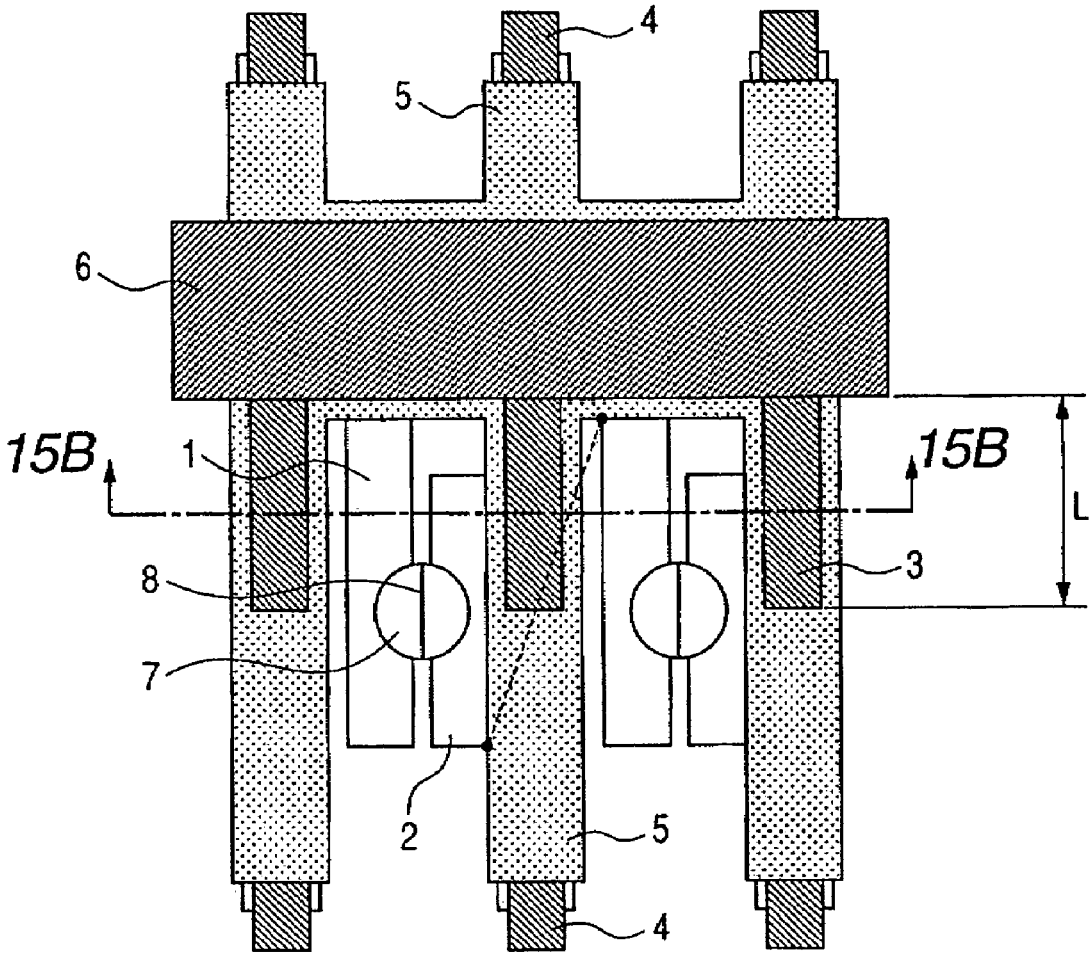
FIGS. 15A and 15B are diagrams of schematically showing a configuration of a pixel of another embodiment of the present invention.
Figure 15B:
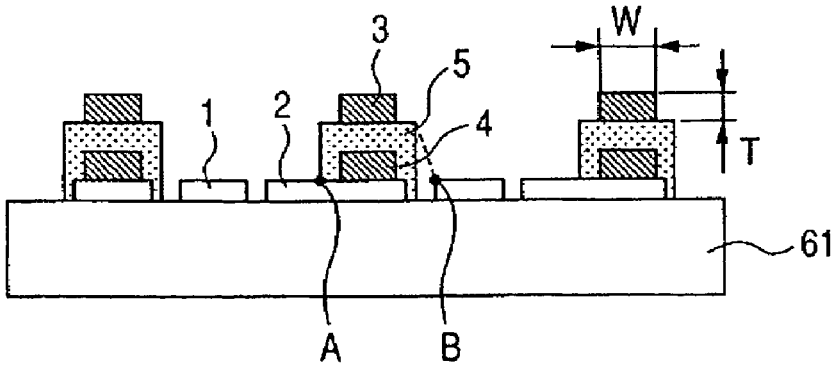

An example how to dispose the additional electrode 3 related to the present configuration will be described with FIGS. 15S and 15B. FIG. 15A is a plan schematic diagram and FIG. 15B is a sectional schematic diagram cut along the line 15B-15B', and reference numeral in the drawings denote the same, members as those in FIGS. 14A and 14B. In addition, reference characters L, W and T in the drawings denote length, width and thickness of the additional electrode 3 for deriving resistance of Formula (b) related to the present invention.

In the configuration in FIGS. 15A and 15B, the additional electrode 3 was disposed in such a location as to intercept between the adjacent electron-emitting devices or the adjacent triple junction of mutual devices. That is, the additional electrode 3 was disposed in such a location to intercept the straight line route of connecting the circumference point A in the portion where a certain device electrode 2 and the insulating layer 5 are overlapped to the point B that is closest to the point A among the circumference (triple junction) in the portion where the device electrodes 1 and 2 and the insulating layer 5 in the device being adjacent to the point A are overlapped. Thereby, it will become possible for the additional electrode 3 to intercept a site where a secondary discharge being apt to arise between the adjacent devices, that is, to arise accompanied by the primary discharge and to absorb the secondary discharge so as to enable prevention of damage to the adjacent devices against the secondary discharge. Here, the reason why the point A and the point B are apt to become sites where the secondary discharge arises will be described with an electric field enhancement coefficient β.

Figure 16:
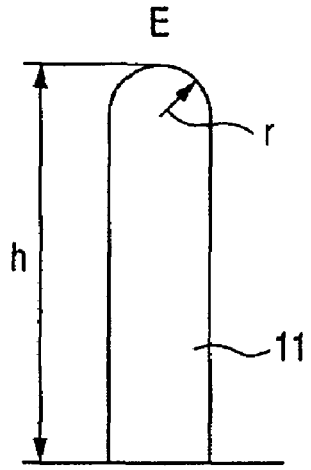
FIG. 16 is a model diagram for describing an electric field enhancement coefficient.

At the time when an electric field E is locally multiplied in accordance with the shape of a system where an electric field $E_0$ is given, electric field enhancement coefficient β is a coefficient of showing a proportion of that multiplication ($\beta=E/E_0$). For example, when the electric field $E_0$ is given to a protruding shape as shown in FIG. 16, the electric field E by the shape is given as $E=\beta\times E_0$. Here, in case of a micro protrusion 11 with the tip shaped as a hemispherical cylinder, $$\beta=2+(h/r)$$

is approximately derived with h being height of the cylinder and r being the curvature radius.

Figure 17A:
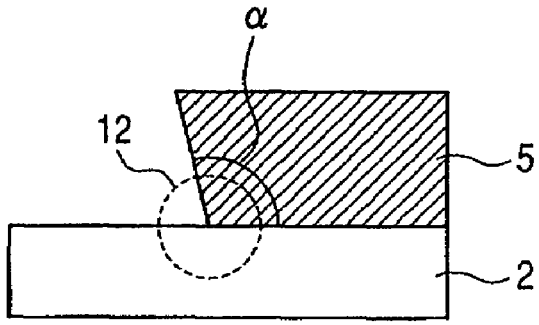
FIGS. 17A and 17B are model diagrams for describing an electric field enhancement coefficient.
Figure 17B:
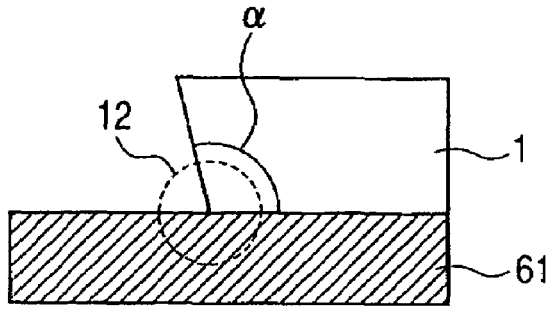

The triple junction 12 is nominated as a location where that β is large. For example, as shown in FIG. 17A, it is the site where the device electrode 2 (or 1) contacts the insulating layer 5 and, as shown in FIG. 17B, the site where the substrate 61 contacts the device electrode 1 (or 2), that is, the contact point of dielectric (relative permittivity $\epsilon_1$)/conductive material/vacuum (relative permittivity $\epsilon_0$). Since the electric field here $E \propto$(distance $L_0$ to the triple junction 9)$^m$ at the time of $\epsilon_1>\epsilon_0$ ($m<0$ at the time of $\alpha>90°$), $\beta=E/E_0$ will become theoretically the maximum. Accordingly, it is highly possible for β to become the maximum at the point A and the point B (see "Electric Field Concentration in Composite Dielectric", by Kaoru. Takuma, Proceedings of the Institute of Electrostatics Japan, Vol. 14 No. 1, (1990)).

In case of a surface conduction electron-emitting device, as shown in FIGS. 15A and 15B, normally electric field enhancement coefficient β will become the maximum at the above described triple junction or at the end portions of the device electrodes 1 and 2, the electric field will become the maximum in the place where the distance of mutually adjacent device electrode 1 or 2 is shortest.

In case of an image display apparatus having a cold cathode electron-emitting device by a spinto type, a carbon nanotube type or a protrusion shape similar thereto, the electric field-enhancement coefficient β in that cold cathode is larger than that due to an effect of the shape of another wiring by several digits to around ten digits. Besides such a site, the location point B where the electric field normally becomes the maximum is a counterpart location closest to the location point A of the cold cathode in the adjacent device.

However, in the case where unintended circumstances such as needle-like substance made by crystal growth, foreign material originated by delamination or dropout inside an apparatus, commingling foreign material in the manufacturing process and the like occur, that location may become the point B.

Figure 18A:
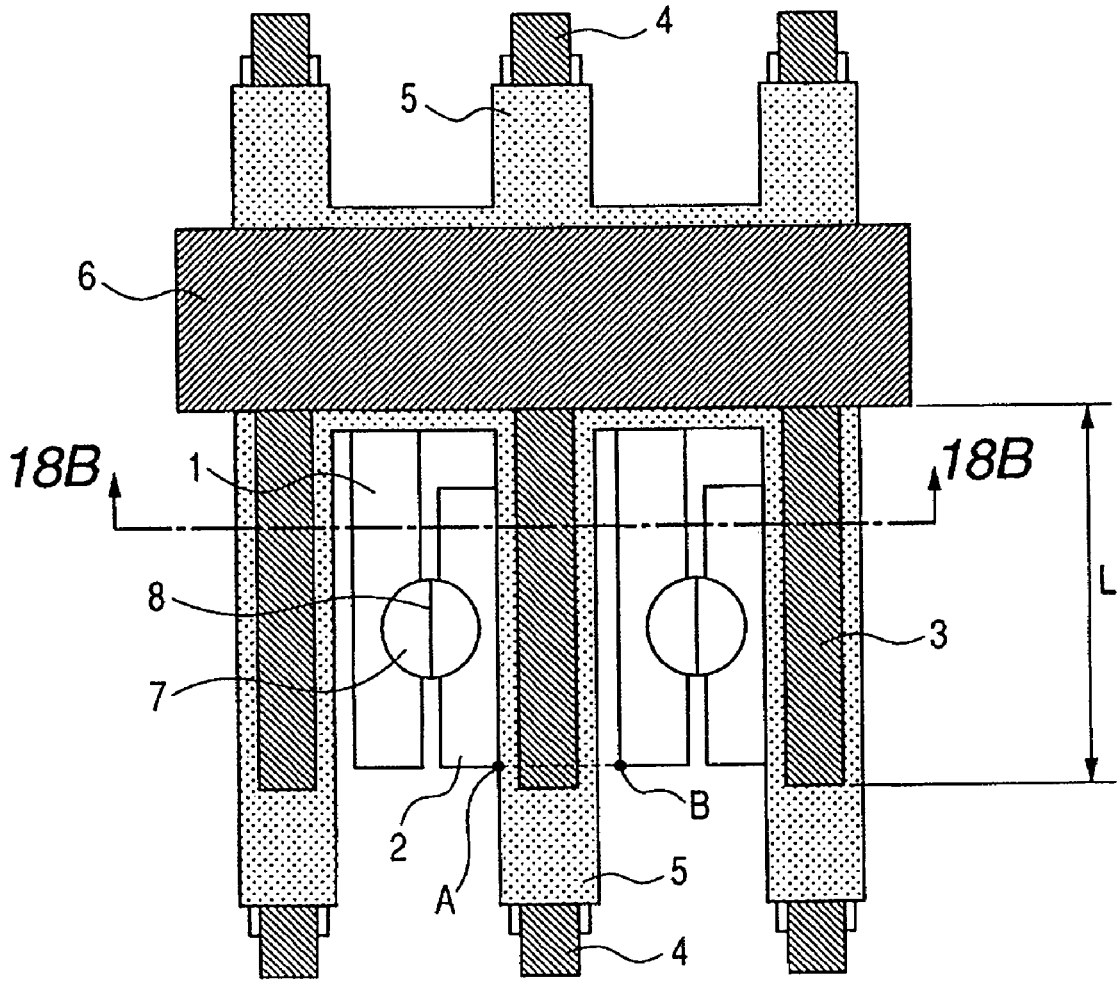
FIGS. 18A and 18B are diagrams of schematically showing a configuration of a pixel of another embodiment of the present invention.
Figure 18B:
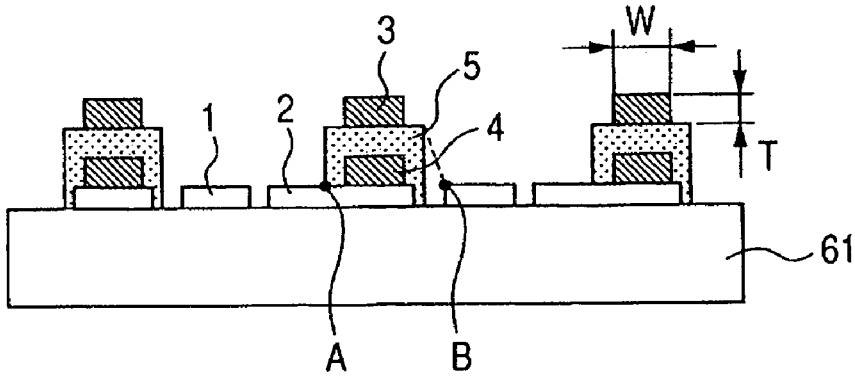

Therefore, the additional electrode 3 is, as shown in FIGS. 18A and 18B, preferably disposed so that all the straight line routes bringing the device electrodes 1, 2 or the device film 7 among the adjacent devices into connection are intercepted by the additional electrode 3.

Figure 19:
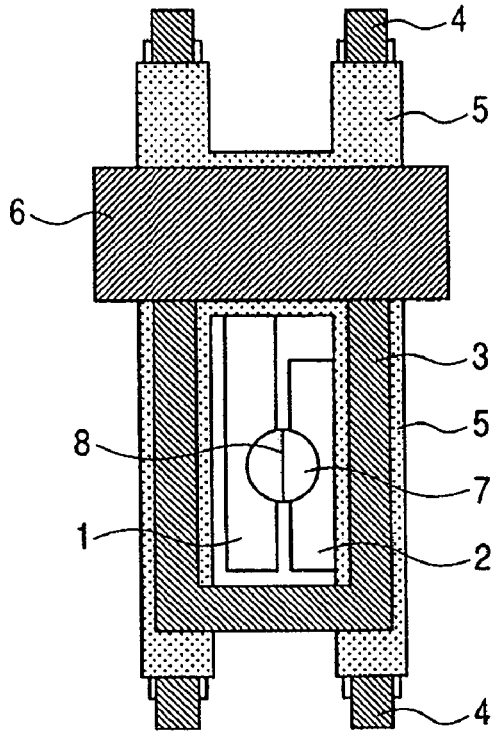
FIG. 19 is a diagram of schematically showing a configuration of a pixel of another embodiment of the present invention.

In addition, as shown in FIG. 19 for example, it is advisable that the additional electrode 3 it disposed so as to intercept between the adjacent devices in the direction in parallel to the scan signal wiring 6 and the information signal wiring 4 respectively. In such a configuration, an effect of preventing surface creeping discharge due to the electric field brought by an accidental shape due to needle-lie substance and foreign materials etc. will increase further.

Figure 20:
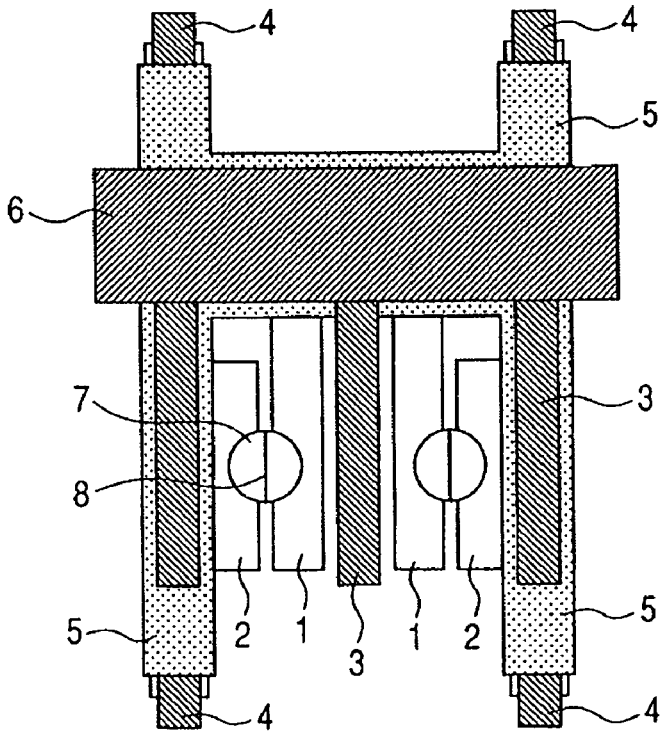
FIG. 20 is a diagram of schematically showing a configuration of a pixel of another embodiment of the present invention.

Here, in the above described configuration example, all the additional electrodes 3 were formed through the insulating layer 5 on the information signal wiring 4 being bottom wiring, but the present invention will not be limited thereto. For example, as in FIG. 20, in case of having a configuration with no information-signal wiring 4 being present between the adjacent devices, forming of the additional electrode 3 onto the substrate will do.

Moreover, when an insulating layer 5 is provided over an information signal wiring 4 like the above described embodiment, a creeping discharge into the information wiring 4 can be prevented. In general, the information wiring 4 has a resistance 2-50 times larger than that of the scanning wiring 6. Accordingly, in case that the discharge current is flown into the scanning signal wiring 6, a voltage increasing would rather be smaller. That is, in case of the structure wherein the discharge current flows into preferentially into the scanning wiring 6 of low resistance, such stronger durability against the discharge can be provided.

Figure 21A:
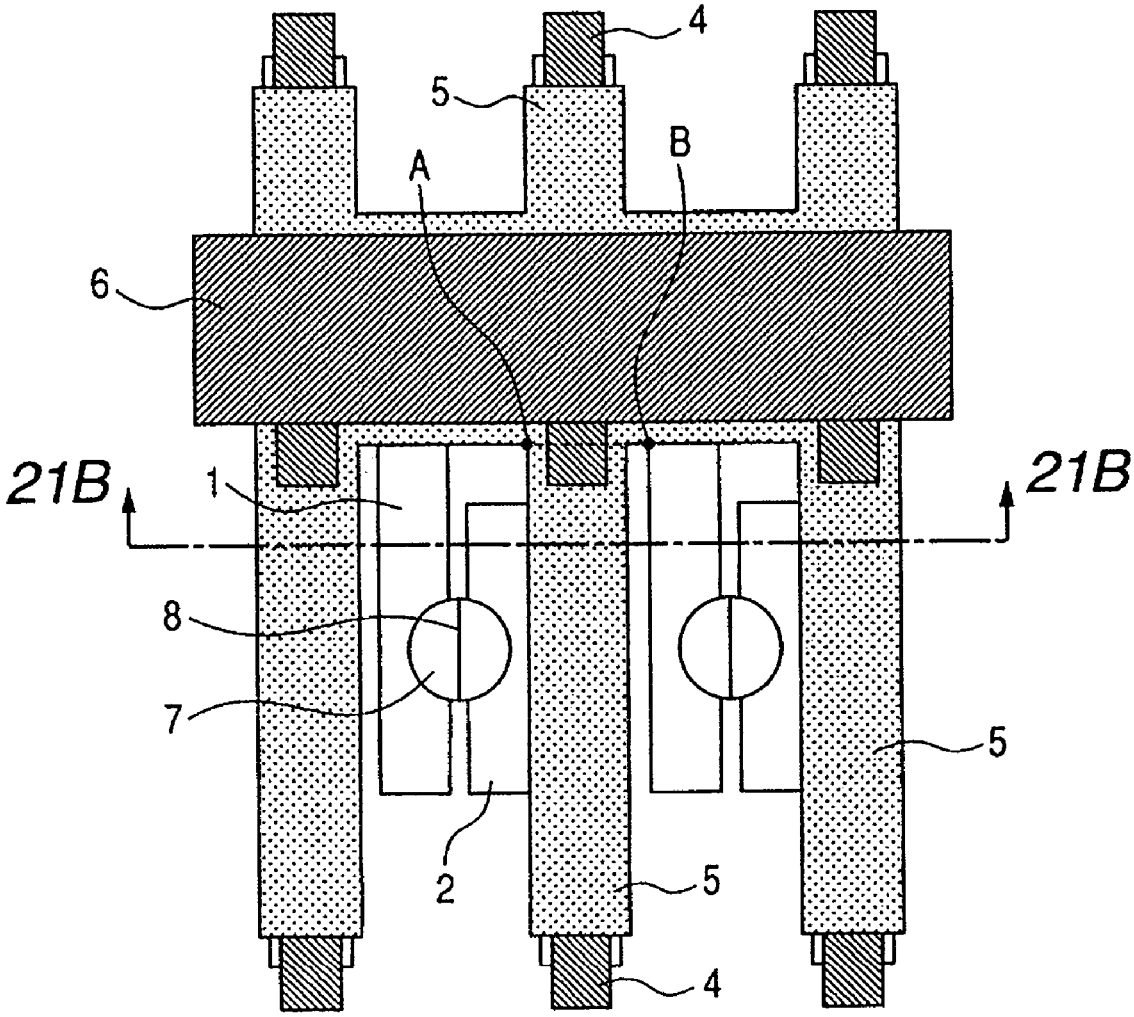
FIGS. 21A and 21B are diagrams of schematically showing a configuration of a pixel of another embodiment of the present invention.
Figure 21B:
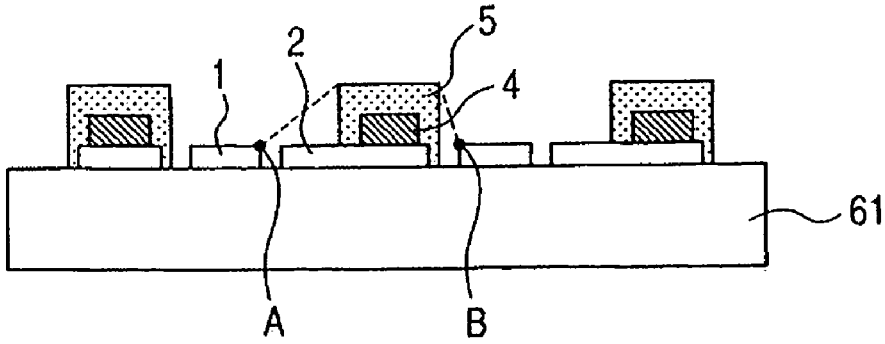

Here, in the present invention, with the configuration where an additional electrode is disposed in such a location to intercept a portion among triple junction between adjacent devices, a function of restraining secondary discharge between A-B can be derived. Therefore, it is advisable that the additional electrode 3 in the present invention is at least formed, as shown in FIGS. 21A and 21B, in such a location to intercept at least a portion of the route between triple junctions between the adjacent devices. The point A in FIGS. 21A and 21B is configured to intercept with the additional electrode 3 the triple junction adjacent to the device electrode 1 on the side that is apt to become a site where discharge arises and where low potential is applied. The reason why the point A is apt to become a site where discharge arises is as described in the above described FIGS. 13A to 13F etc.

Example 5

An image display apparatus provided with a configuration shown in FIGS. 14A and 14B was produced in accordance with a manufacturing process in FIGS. 22A to 22E.

Figure 22A:
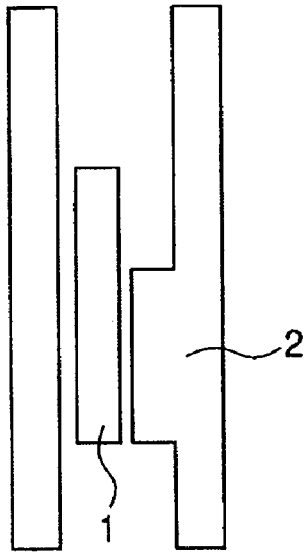
FIGS. 22A, 22B, 22C, 22D and 22E are schematic diagrams showing manufacturing steps of the rear plate in FIGS. 14A and 14B.

In the present example, with a sputtering method with Pt being targeted, Pt film having film thickness of around 0.08 μm was formed over the whole surface of the substrate and thereafter, subject to patterning with photolithography, the device electrode 1 and 2 were formed. Here, so that highly dense pattern designing is feasible, the patterns of the device electrodes 1 and 2 were set to patterns with non-equal length between left and right (FIG. 22A).

Figure 22B:
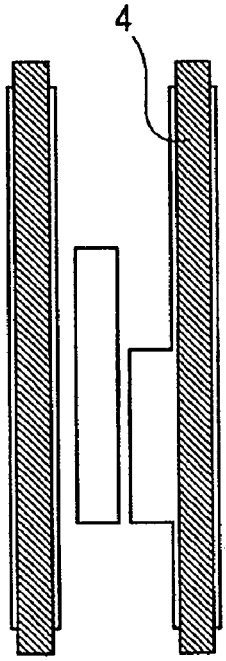

Next, the information signal wiring 4 was formed by screen printing with paste for screen printing containing Ag as a conductor component (FIG. 22B).

Figure 22C:
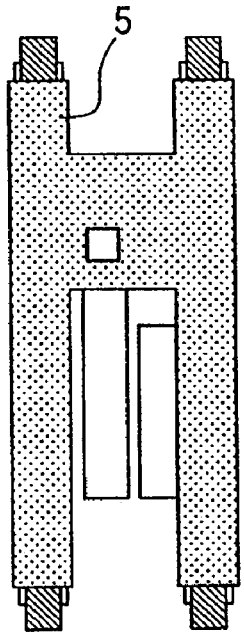

Next, past in mixture of PbO as the main component, glass binder, resin and photosensitive component was used and underwent burning at 480° C. for the peak retaining time of 10 minutes so that the insulating layer 5 was formed (FIG. 22C). Normally, in order to secure insulation property between the upper and the bottom wiring sufficiently, the inter-layer-insulating layer undergoes overall printing, pattern exposure, development, drying and burning repeatedly. Various types of pattern forming methods are feasible, and in the present example, (1) overall printing and (2) IR drying were repeated twice, and then (3) pattern exposure, (4) development and (5) burning were implemented in that order. Here, the total number of film is increased or decreased in consideration of the insulating property. Hollow region shaped as a contact hole was formed in the insulating layer 5 so that a portion of the device electrode 1 is exposed.

Figure 22D:
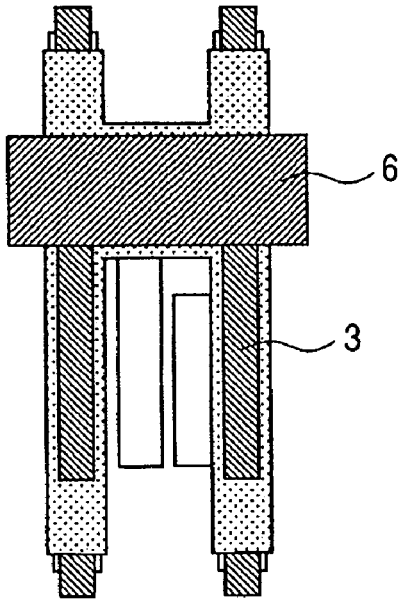

Lastly, with the same paste as in the information signal wiring 4, the scan signal wiring 6 and the additional electrode 3 were formed by thick film screen printing method (FIG. 22D). The additional electrode 3 was formed to have W=20 μm, T=5 μm and L=100 μm.

Energy Ee of the additional electrode 6 of the present example is, $$P=20\times10^{-6}\times5\times10^{-6}\times100\times10^{-6}=1.0\times10^{-14}\ [m^3]$$

Cp=230 [J/kgK]

$\rho=1.05\times10^4$ [kg/m$^3$]

Tm=962 [° C.]

and therefore, $$Ee=2.3\times10^{-5}\ [J]$$

On the other hand, energy Ea due to discharge is,

I=3 [A]

$$R=1.6\times10^{-8}\times100\times10^{-6}/(20\times10^{-6}\times5\times10^{-6})=1.6\times10^{-2}\ [\Omega]$$

$$t_1=2\times10^{-7}\ [sec]$$

deriving, $$Ea=2.9\times10^{-9}\ [J]$$

and therefore, $$Ee>Ea$$

is fulfilled.

Figure 22E:
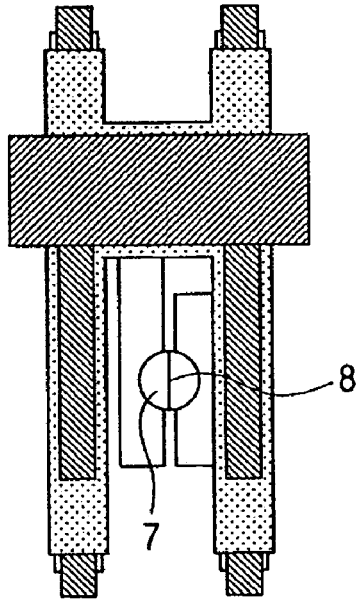

After completion of the above described wiring, the device film 7 and the electron-emitting device 8 were formed likewise Example 1 (FIG. 22E).

Thereafter, the above described substrate, the face plate where the fluorescent film and the metal back were fabricated onto the glass substrate were pasted together though a frame in the circumference portion and thus an outer fence device was formed.

In addition, as a comparative example, a display panel with completely the same configuration except that no additional electrode 3 was formed.

In the above described display panel, the present example and the comparative example were the same in the point of view that discharge arose at a certain point as voltage applied to the metal back of the face plate got higher and higher. However, as a result of observation on damage due to discharge that arose, it was confirmed that damage was present in a plurality of pixels in the display panel of the comparative example while damage was limited to a single pixel in the display panel of the example.

In the present invention, there provided is an electron beam apparatus of causing discharge current to flow in an additional electrode connected and added to a device electrode, thereby of preventing melting and line breakage of the device electrode and of preventing surface creeping discharge. Moreover, the additional electrode can be fabricated simultaneously during a process of producing wiring, and therefore requires no new process to be added and can be manufactured without accompanying cost increase and efficiency drop in manufacturing process.

This application claims priorities from

Japanese Patent Application Nos. 2005-016629 filed on Jan. 25, 2005, and 2005-016630 filed on Jan. 25, 2005, which are hereby incorporated by reference herein.

What is claimed is:

1. An electron beam apparatus comprising:

a rear plate comprising a plurality of electron-emitting devices each comprising a pair of device electrodes, a plurality of first wirings each of which is connected to one of the pair of device electrodes of the electron-emitting device, and a plurality of second wirings each of which is connected to the other of the pair of device electrodes, wherein the second wirings cross the first wirings sandwiching an insulating layer therebetween; and a face plate, comprising an anode electrode, disposed in opposition to said rear plate, and irradiated with electron emitted from said electron-emitting device;

wherein at least one of said pair of device electrodes has a portion covered with said insulating layer and connected to said first or second wirings, an additional electrode is electrically connected to the device electrode covered with the insulating layer and the additional electrode meets following formulas (a) to (c):

$$Ee=P\times Cp\times\rho\times Tm \quad (a)$$

$$Ea=R\times I^2\times t_1 \quad (b)$$

$$Ee>Ea \quad (c)$$

P: volume [$m^3$]

Cp: specific heat [J/kgK]

ρ: density [$kg/m^3$]

Tm: melting point [K]

R: resistance [106 ]

I: permissible current value [A]

$t_1$: duration of electric discharging [sec].

2. The electron beam apparatus according to claim 1, wherein said duration of electric discharging $t_1$ is stipulated with a following formula (d):

$$t_1=2\epsilon XS\times V/(D\times I) \quad (d)$$

ϵ: a dielectric constant between the rear plate and the face plate [F/m]

S: facing area of the rear plate and the face plate [$m^2$]

V: a voltage applied between the rear plate and the anode electrode of the face plate [V]

D: distance between the rear plate and the face plate [m].

3. The electron beam apparatus according to claim 1, wherein said permissible current value I is a permissible current value $I_d$ of a driver IC equipped in the corresponding electron beam apparatus.

4. The electron beam apparatus according to claim 1, wherein said anode electrode is connected to a high voltage power source through a current limited resistance.

5. The electron beam apparatus according to claim 4, wherein said permissible current value I is 0.1 to 3.0 [A].

6. The electron beam apparatus according to claim 1, wherein a device electrode to which said additional electrode is connected has a site where resistance varies discontinuously in vicinity of the additional electrode.

7. An electron beam apparatus comprising:

a rear plate comprising a plurality of electron-emitting devices comprising a pair of device electrodes, a plurality of first wirings each of which is connected to one of the pair of device electrodes of the electron-emitting device, and a plurality of second wirings each of which is connected to the other of the pair of the device electrodes, wherein the second wirings cross the first wirings sandwiching an insulating layer therebetween; and a face plate, disposed in opposition to said rear plate, comprising an anode electrode and a light emitting member emitting light responsive to an irradiation with an electron emitted from said electron-emitting device, wherein an additional electrode electrically connected to either of said first wiring or said second wiring is provided between adjacent electron-emitting devices and the additional electrode meets following formulas (a) to (c):

$$Ee=P\times Cp\times\rho\times Tm \quad (a)$$

$$Ea=R\times I^2\times t_1 \quad (b)$$

$$Ee>Ea \quad (c)$$

P: volume [$m^3$]

Cp: specific heat [J/kgK]

ρ: density [$kg/m^3$]

Tm: melting point [K]

R: resistance [Ω] of an area ranging from a site connected to wiring to an end portion in opposition to the site I: permissible current value [A]

$t_1$: duration of electric discharging [sec].

8. The electron beam apparatus according to claim 7, wherein said additional electrode is disposed so as to intercept at least a portion of a straight line route extending between a triple junction of one of said adjacent electron-emitting devices and a triple junction of the other of said adjacent electron-emitting devices.

* * * * *